US008982042B2

(12) United States Patent
Suwabe et al.

(10) Patent No.: US 8,982,042 B2
(45) Date of Patent: Mar. 17, 2015

(54) IMAGE DISPLAY MEDIUM DRIVER, IMAGE DISPLAY DEVICE, AND IMAGE DISPLAY MEDIUM DRIVING METHOD

(75) Inventors: Yasufumi Suwabe, Kanagawa (JP); Masaaki Abe, Kanagawa (JP); Yoshinori Machida, Kanagawa (JP); Hiroaki Moriyama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 327 days.

(21) Appl. No.: 13/447,941

(22) Filed: Apr. 16, 2012

(65) Prior Publication Data

US 2013/0135361 A1 May 30, 2013

(30) Foreign Application Priority Data

Nov. 29, 2011 (JP) ..... 2011-260415

(51) Int. Cl.
*G09G 3/34* (2006.01)

(52) U.S. Cl.
CPC ..... *G09G 3/34* (2013.01)
USPC ..... 345/107

(58) Field of Classification Search
CPC ..... G09G 3/344; G02F 1/167
USPC ..... 345/107
See application file for complete search history.

(56) References Cited

U.S. PATENT DOCUMENTS

| | | | | |
|---|---|---|---|---|
| 4,806,443 | A | 2/1989 | Yanus et al. | |
| 8,294,663 | B2 * | 10/2012 | Miyazaki | 345/107 |
| 2007/0262949 | A1 * | 11/2007 | Zhou et al. | 345/107 |
| 2008/0112040 | A1 * | 5/2008 | Suwabe et al. | 359/296 |

FOREIGN PATENT DOCUMENTS

| | | |
|---|---|---|
| JP | A-3-213827 | 9/1991 |
| JP | A-7-325434 | 12/1995 |
| JP | A-10-3177 | 1/1998 |
| JP | A-2006-343457 | 12/2006 |
| JP | A-2009-251032 | 10/2009 |

* cited by examiner

*Primary Examiner* — Allison Johnson
(74) *Attorney, Agent, or Firm* — Oliff PLC

(57) ABSTRACT

An image display medium driver includes a voltage applying unit that applies a voltage between a pair of substrates of an image display medium that displays an image, the image display medium including plural groups of colored particles colored in a color which is different for every group, at least one of the substrates having transparent properties, each group of colored particles moved when the voltage equal to or higher than a threshold voltage in terms of absolute value, that is different for every group, and a controller that determines a substrate on which the colored particles are present for each group of colored particles based on the last image information used for displaying an image.

4 Claims, 21 Drawing Sheets

IMAGE DISPLAY MEDIUM DRIVER, IMAGE DISPLAY DEVICE, AND IMAGE DISPLAY MEDIUM DRIVING METHOD

CROSS-REFERENCE TO RELATED APPLICATIONS

This application is based on and claims priority under 35 USC 119 from Japanese Patent Application No. 2011-260415 filed Nov. 29, 2011.

BACKGROUND (i) Technical Field

The present invention relates to an image display medium driver, an image display device, and an image display medium driving method.

(ii) Related Art

In the related art, an image display device using colored particles is known as a rewritable image display medium having a memory performance. Such an image display medium is configured to include, for example, a pair of substrates and plural particles which are enclosed between the substrates so as to be movable between the substrates in accordance with an applied electric field and which have different colors and charging characteristics.

In such an image display medium, a voltage corresponding to an image is applied between a pair of substrates, whereby particles are moved, and the image is displayed as the contrast of the particles of different colors. Moreover, even after the application of voltage is stopped after the image is displayed, the particles remain adhered to the substrates due to van der Waals force or image force, and the image display is maintained.

SUMMARY

According to an aspect of the present invention, there is provided an image display medium driver including: a voltage applying unit that applies a voltage between a pair of substrates of an image display medium that displays an image based on image information, the image display medium including plural groups of colored particles colored in a color which is different for every group, enclosed between the pair of substrates, at least one of the substrates having transparent properties, each group of colored particles moved when the voltage equal to or higher than a threshold voltage in terms of absolute value, that is different for every group; and a controller that determines a substrate on which the colored particles are present for each group of colored particles based on the last image information used for displaying an image, and when the colored particles are present on both of the pair of substrates, controls the voltage applying unit so as to apply a voltage having a smaller absolute value than any threshold voltage of colored particles present on one substrate, and the smaller voltage applied in a direction from the one substrate toward the other substrate side.

BRIEF DESCRIPTION OF THE DRAWINGS

Exemplary embodiments of the present invention will be described in detail based on the following figures, wherein:

FIGS. 9A and 98 are diagrams showing an example of a voltage applied to improve a memory performance when all (or a majority part) of first colored particles are moved to a display substrate side after an image is written in the image display device according to the first exemplary embodiment of the present invention;

DETAILED DESCRIPTION

Figure 1:
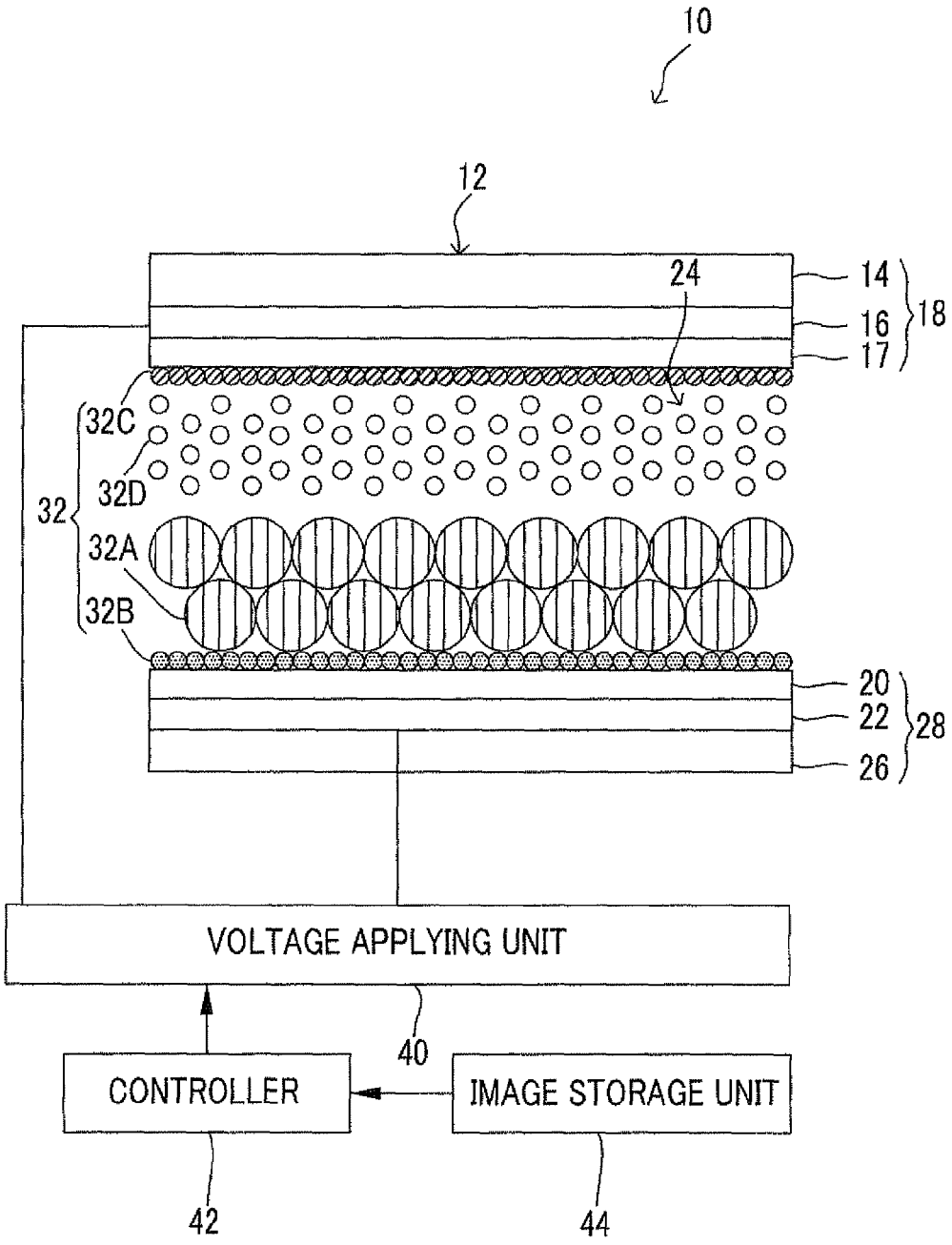
FIG. 1 is a schematic configuration diagram showing an image display device according to a first exemplary embodiment of the present invention.

Hereinafter, exemplary embodiments of the present invention will be described in detail with reference to the drawings. In the following description, members having substantially the same functions will be denoted by the same reference numerals throughout all drawings, and redundant description is omitted appropriately.

In the present specification, a memory performance means a performance of maintaining an image display state. Moreover, refresh means applying a voltage again so that an image display state is maintained, specifically so that colored particles are not separated from a substrate. Furthermore, a threshold voltage means a voltage at which colored particles start moving.

(First Exemplary Embodiment)

FIG. 1 is a schematic configuration diagram showing an image display device according to a first exemplary embodiment of the present invention. FIG. 1 shows an example where a cyan image is displayed.

As shown in FIG. 1, an image display device 10 according to the first exemplary embodiment of the present invention is configured to include an image display medium 12 that displays an image with a movement of colored particles 32 described later and a controller 42 that controls the driving of a voltage applying unit 40 based on image data stored in an image storage unit 44 in response to an image display instruction from an external image signal output device such as a personal computer.

The image display medium 12 is configured to include a transparent display substrate 18 serving as an image display surface and a back substrate 28 disposed so as to face the display substrate 18 with a predetermined gap therebetween. The image display medium 12 may include a spacer member that partitions the space between the display substrate 18 and the back substrate 28 into plural cells. In this case, a cell means a region surrounded by the display substrate 18, the back substrate 28, and the spacer member. Moreover, the spacer member may be provided so as to correspond to each pixel when an image is displayed on the image display medium 12, may be provided so as to include plural pixels, and may be provided so as to divide the space within one pixel into plural cells.

Alternatively, the image display medium may be configured such that the image display medium is partitioned between the substrates by microcapsules formed of transparent partition walls. When the image display medium is partitioned by microcapsules, the microcapsules may be disposed so as to include plural pixels, and plural microcapsules (alternatively, plural partial microcapsules) may be disposed so as to be included in a pixel.

A dispersion liquid 24 having transparent properties is enclosed between the display substrate 18 and the back substrate 28, and four groups of colored particles 32 (first, second, third, and fourth colored particles 32A, 32B, 32C, and 32D) are included in the dispersion liquid 24. In the present exemplary embodiment, three groups of colored particles (the first, second, and third colored particles 32A, 32B, and 320) among the four groups of colored particles 32 are moved in accordance with the intensity of an electric field formed between the substrates. Here, the transparent properties means that the transmittance of visible light is 70% or higher, and preferably, 90% or higher.

The display substrate 18 has a configuration in which a surface electrode 16 and a surface layer 17 are sequentially stacked on a support substrate 14. The back substrate 28 has a configuration in which a back electrode 22 and a surface layer 20 are sequentially stacked on a support substrate 26.

Examples of the material of the support substrates 14 and 26 include glass and plastic such as, for example, a polycarbonate resin, an acrylic resin, a polyimide resin, a polyester resin, an epoxy resin, or a polyethersulfone resin.

Examples of the material of the surface electrode 16 and the back electrode 22 include oxides of indium, tin, cadmium, antimony, and the like, composite oxides such as ITO, metals such as gold, silver, copper, or nickel, and organic materials such as polypyrrole or polythiophene. These materials may be formed into a single-layer film or a composite film, or in a composite film by an evaporation method, a sputtering method, an application method, and the like. Moreover, the thickness of the film is generally 100 to 2000 Å according to an evaporation method or a sputtering method. The surface electrode 16 and the back electrode 22 may be formed in a desired pattern by a known means, for example, by etching an existing liquid crystal display element or a printed substrate. For example, the surface electrode 16 and the back electrode 22 may be formed in an optional segmented form or a stripe form which enables passive matrix driving.

The surface electrode 16 may be embedded in the support substrate 14, and similarly, the back electrode 22 may be embedded in the support substrate 26. In this case, since the materials of the support substrates 14 and 26 may affect the electrical or magnetic properties and the fluidity of the respective colored particles 32, it is necessary to select the materials according to the compositions or the like of the respective particles.

Moreover, the surface electrode 16 and the back electrode 22 may be separated from the display substrate 18 and the back substrate 28, respectively, so that they are disposed outside the image display medium 12. In the present exemplary embodiment, although a case where electrodes (the surface electrode 16 and the back electrode 22) are provided to both the display substrate 18 and the back substrate 28 is described, the electrodes may be provided to any one of the substrates.

Moreover, in order to enable active matrix driving, the support substrates 14 and 26 may include a thin film transistor (TFT) for each pixel. In this case, the TFTs are preferably formed on the back substrate 28 rather than the display substrate 18 in order to facilitate stacking of wirings and mounting of components.

When the image display medium 12 employs passive matrix driving, it is possible to simplify the configuration of the image display device 10. When the image display medium 12 employs active matrix driving using TFTs, it is possible to increase the speed in which an image is displayed on the entire image display medium as compared to the passive matrix driving.

Moreover, when the surface electrode 16 and the back electrode 22 are formed on the support substrates 14 and 26, respectively, it is preferable to form a surface layer serving as a dielectric film on the surface electrode 16 and the back electrode 22 as necessary in order to prevent breaking of the surface electrode 16 and the back electrode 22 or the occurrence of a current leakage between electrodes, which makes the colored particles 32 immovable. Examples of the material constituting the surface layer include polycarbonate, polyester, polystyrene, polyimide, epoxy, polyisocyanate, polyamide, polyvinyl alcohol, polybutadiene, polymethylmethacrylate, nylon copolymers, an acrylic ultraviolet curing resin, and a fluorine resin.

Examples of the material constituting the dielectric film include the above-described materials and materials in which a charge transport substance is contained in any one of the materials. Examples of the charge transport substance include hydrazone compounds, stilbene compounds, pyrazoline compounds, and arylamine compound which are hole transport substances. Moreover, examples of the charge transport substance include fluorenone compounds, derivative diphenoquinone, pyran compounds, and zinc oxide which are electron transport substances. Furthermore, a self-supporting resin having charge transporting properties may be used as the charge transport substance. Specific examples of the charge transport substance include polyvinyl carbazole and polycarbonate obtained by polymerization of a specific dihydroxy arylamine and a specific bischloroformate described in U.S. Pat. No. 4,806,443. Moreover, since the surface layer as the dielectric film affects the charging characteristics and fluidity of the respective colored particles 32, it is necessary to select the material thereof according to the compositions or the like of the respective colored particles 32.

Moreover, since the display substrate 18 constituting the image display medium 12 needs to have transparent properties as described above, materials having transparent properties among the above-described respective materials are used.

When the spacer member is provided, the spacer member may be formed of a thermoplastic resin, a thermosetting resin, an electron beam curable resin, a photo-curing resin, rubber, metal, and the like. Moreover, the spacer member may be integrated with any one of the display substrate 18 and the back substrate 28. In this case, the spacer member may be manufactured by an etching process of etching either one of the support substrates 14 and 26, a laser machining process, or a press working process using a mold manufactured in advance. Alternatively, the spacer member may also be manufactured by a printing method, an inkjet method, and the like. In addition, the spacer member may be manufactured on at least one of the display substrate 18 side and the back substrate 28 side. Moreover, the spacer member may be colored or colorless, but it is preferable for the spacer member to be achromatic or colorless and transparent so that the spacer member does not adversely affect an image displayed on the image display medium 12. In this case, for example, a transparent resin such as polystyrene, polyester or acrylic may be used.

A dispersion medium 28 in which the respective colored particles 32 are dispersed is preferably a high resistance liquid. Here, "high resistance" means that a volume resistivity thereof is $10^7$ Ω/cm or higher, and preferably, $10^{10}$ Ω/cm or higher, and more preferably, $10^{12}$ Ω/cm or higher.

As the high resistance liquid, specifically, hexane, cyclohexane, toluene, xylene, decane, hexadecane, kerosene, paraffin, isoparaffin, silicone oil, dichloroethylene, trichloroethylene, perchloroethyelene, high-purity oil, benzene, diisopropyl naphthalene, olive oil, trichlorotrifluoroethane, tetrachloroethane, dibromotetrafluoroethane, and mixtures thereof may be preferably used.

Although an acid, an alkali, a salt, a dispersion stabilizer, a stabilizer for the purpose of oxidation prevention or ultraviolet absorption, an antimicrobial and an antiseptic may be added to the high resistance liquid as necessary, it is preferable to add these such that they are within the range of the specific volume resistivity values described above.

Moreover, an anionic surfactant, a cationic surfactant, an amphoteric surfactant, a nonionic surfactant, fluorochemical surfactant, a silicone surfactant, a metal soap, an alkyl phosphate ester and an imide succinate may be added to the high resistance liquid as a charge control agent and used.

As the ionic and nonionic surfactants, more specific examples may include the following. Examples of the nonionic surfactant may include polyoxyethylene nonylphenyl ether, polyoxyethylene octylphenyl ether, polyoxyethylene dodecylphenyl ether, polyoxyethylene alkyl ether, polyoxyethylene fatty acid ester, sorbitan fatty acid ester, polyoxyethylene sorbitan fatty acid ester, and fatty acid alkyrolamide. Examples of the anionic surfactant may include alkyl benzene sulfonate, alkyl phenyl sulfonate, alkyl naphthalene sulfonate, higher fatty acid salt, sulfates of higher fatty acid esters, and sulfonates of higher fatty acid esters. Examples of the cationic surfactant may include primary to tertiary amine salts and quaternary ammonium salt. It is preferable for these charge control agents to be 0.01% by weight or more and 20% by weight or less with respect to the particle solid content, and a range of 0.05% to 10% by weight is particularly preferable. When these charge control agents are less than 0.01% by weight, the desired charging controlling effect is insufficient, and when these charge control agents exceed 20% by weight, this triggers an excessive rise in the conductivity of the dispersion liquid.

Examples of the particles of the colored particles 32 that are dispersed in the dispersion liquid 28 may include glass beads, alumina, metal oxide particles such as titanium oxide, thermoplastic or thermosetting resin particles, particles where a colorant has been fixed to the surfaces of these resin particles, particles that include a colorant in thermoplastic or thermosetting resin, and metal colloid particles that have a plasmon coloring function.

Examples of the thermoplastic resin used for manufacturing the particles include homopolymers and copolymers of styrenes such as styrene and chlorostyrene, monolefins such as ethylene, propylene, butylenes and isoprene, vinyl esters such as vinyl acetate, vinyl propionate, vinyl benzoate, and vinyl butyrate, α-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, and dodecyl methacrylate, vinyl ethers such as vinyl methyl ether, vinyl ethyl ether, and vinyl butyl ether, and vinyl ketones such as vinyl methyl ketone, vinyl hexyl ketone, and vinyl isopropenyl ketone.

Moreover, examples of the thermosetting resin used for manufacturing the particles include a cross-linked resin such as a cross-linked copolymer or a cross-linked polymethyl methacrylate whose main component is divinylbenzene, phenol resin, urea resin, melamine resin, polyester resin, or silicone resin. Particularly representative bonding resins include polystyrene, styrene-alkyl acrylate copolymer, styrene-alkyl methacrylate copolymer, styrene-acrylonitrile copolymer, styrene-butadiene copolymer, styrene-maleic anhydride copolymer, polyethylene, polypropylene, polyester, polyurethane, epoxy resin, silicone resin, polyimide, modified rosin, and paraffin wax.

As the colorant, an organic or inorganic pigment or an oil-soluble dye may be used. Examples of the colorant include magnetic powder such as magnetite or ferrite and publicly known colorants such as carbon black, titanium oxide, magnesium oxide, zinc oxide, phthalocyanine copper cyan color material, azo yellow color material, azo magenta color material, quinacridone magenta color material, red color material, green color material, and blue color material. Specifically, representative examples thereof include aniline blue, carcoil blue, chrome yellow, ultramarine blue, Du Pont oil red, quinoline yellow, methylene blue chloride, phthalocyanine blue, malachite green oxylate, lampblack, rose bengal, C.I. pigment red 48:1, C.I. pigment red 122, C.I. pigment red 57:1, C.I. pigment yellow 97, C.I. pigmentblue 15:1, and C.I. pigment blue 15:3.

A charge control agent may also be mixed in with the particle resin as necessary. As the charge control agent, a publicly known charge control agent that is used in electrophotographic toner material may be used; examples thereof may include cetyl pyridyl chloride, quaternary ammonium salts such as BONTRON P-51, BONTRON P-53, BONTRON E-84 and BONTRON E-81 (manufactured by Orient Chemical Industries, Ltd.), salicylic acid metal complexes, phenol condensates, tetraphenyl compounds, metal oxide particles, and metal oxide particles that have been surface-treated by various groups of coupling agents.

An external additive may also be adhered as necessary to the surfaces of the particles. It is preferable for the color of the external additive to be transparent so as not to affect the color of the particles. As the external additive, there are used inorganic particles of metal oxides such as silicon oxide (silica), titanium oxide, and alumina. In order to adjust the charging characteristics, fluidity and environmental dependency of the particles, these may be surface-treated by a coupling agent or silicone oil. Examples of the coupling agent include those having positive charging characteristics, such as aminosilane-based coupling agents, aminotitanium-based coupling agents, and nitrile-based coupling agents, and those having negative charging characteristics, such as nitrogen-free (composed of atoms other than nitrogen) silane-based coupling agents, titanium-based coupling agents, epoxy silane coupling agents, and acrylsilane coupling agents. Moreover, examples of the silicone oil include those having positive charging characteristics, such as amino-denatured silicone oil, and those having negative charging characteristics, such as dimethyl silicone oil, alkyl-denatured silicone oils, α-methyl sulfone-denatured silicone oils, methylphenyl silicone oils, chlorphenyl silicone oils, and fluorine-denatured silicone oils.

Among these external additives, well-known hydrophobic silica and hydrophobic titanium oxide are preferred, and titanium compounds as described in JP-A-10-3177, which are obtained by the reaction between $TiO(OH)_2$ and a silane compound such as a silane coupling agent, are particularly preferred. As the silane compound, it is possible to use any group of chlorosilane, alkoxy silane, silazane, and special silylating agents. The titanium compound is produced by reacting $TiO(OH)_2$ prepared by wet process with a silane compound or silicone oil, and drying. As the compound does not pass through a sintering process at several hundred degrees, strong bonds between the Ti molecules are not formed, there is no agglutination at all, and the particles are in a primary particle state. Moreover, as $TiO(OH)_2$ is directly reacted with a silane compound or silicone oil, the processing amount of the silane compound or the silicone oil may be increased, the charging characteristics may be controlled by adjusting the processing amount or the like of the silane compound, and the charging ability that may be imparted may be remarkably improved over that of conventional titanium oxide.

The primary particles of the external additive are generally 5 to 100 nm and more preferably 10 to 50 nm but are not limited thereto.

The mixing ratio between the external additive and the particles is adjusted in consideration of the particle diameter of the particles and the particle diameter of the external additive. When the added amount of the external additive is too much, some of the external additive separates from the particle surfaces and adheres to the surfaces of other particles such that the desired charging characteristics are no longer obtained. Usually, the amount of the external additive is 0.01 to 3 parts by weight or more preferably 0.05 to 1 parts by weight with respect to 100 parts by weight of the particles.

The external additive may be added to just one group of the plural groups of particles or may be added to several groups or to all groups of the particles. When the external additive is added to the surfaces of all the particles, it is preferable to strongly fix the external additive to the surfaces of the particles by driving the external additive into the particle surfaces with an impact force or by heating the particle surfaces. Thus, a situation in which the external additive separates from the particles and external additives of opposite polarities strongly agglutinate and form aggregates of the external additive that are difficult to dissociate by an electric field is prevented. Therefore, image deterioration is prevented.

As the method of preparing the colored particles 32, any conventionally known method may be used. For example, as described in JP-A-7-325434, a method may be used in which a resin, a pigment, and a charge control agent are weighed so as to obtain a predetermined mixing ratio, and the resin is heated and melted, thereafter the pigment is added, mixed, dispersed and cooled. Thereafter, particles are prepared using a mill such as a jet mill, a hammer mill or a turbo mill and, thereafter, the obtained particles are dispersed in a dispersion medium. Moreover, particles containing a charge control agent may also be prepared by a polymerization method such as suspension polymerization, emulsion polymerization or dispersion polymerization, or by a method such as coacervation, melt dispersion or emulsion aggregation, thereafter the particles may be dispersed in a dispersion medium to obtain a particle dispersion medium. Moreover, a method that uses an appropriate device that may disperse and mix raw materials including a resin, a colorant, a charge control agent and a dispersion medium at a temperature at which the resin is plasticizable, the dispersion medium does not boil, and which is lower than the decomposition point of the resin, the charge control agent and/or the colorant may be used. Specifically, the pigment, the resin and the charge control agent are heated and melted in a dispersion medium by a shooting star-type mixer or a kneader, the temperature dependency of the solvent solubility of the resin is utilized, and the melted mixture is stirred, cooled and allowed to coagulate and deposit such that the particles may be manufactured.

The first colored particles 32A of the present exemplary embodiment may be filled such that one layer each is arranged between the display substrate 18 and the back substrate 28. However, it is preferable to fill the first colored particles 32A such that plural layers may be disposed between the substrates since higher concealing ability is obtained. In this case, when the size of the first colored particles 32A increases, the distance between the substrates increases, the display driving voltage increases, and the display switching speed decreases. Thus, the size of the first colored particles 32A is preferably 50 μm or less, and more preferably, 30 μm or less.

Moreover, the particle size of the first colored particles 32A is set such that the second, third, and fourth colored particles 32B, 32C, and 32D may move through the gaps between the first colored particles in a state where the first colored particles clump together (a state where an electric field is applied between the substrates, and the first colored particles move toward the respective substrates and clump together). Specifically, the size of the first colored particles 32A is preferably at least 5 times the size of the other colored particles, and more preferably, at least 10 times when a variation of the particle sizes of the respective colored particles is taken into consideration. Moreover, the moving speed (mobility) of the first colored particles 32A is preferably at most ½ of the moving speed of the other colored particles, and more preferably at most ⅕ of that.

Moreover, although higher resolution image display may be achieved with the smaller size of the other colored particles (the second, third, and fourth colored particles 32B, 32C, and 32D) other than the first colored particles 32A, it is desirable for the size of the other colored particles to be 20 nm or more and 10 μm or less because the moving velocity decreases and the display switching speed decreases and because it becomes difficult to achieve a balance between memory performance of the display and the stability of dispersion.

As examples of the sizes of the respective colored particles 32, the first colored particles 32A may have a size of 10 μm, the second colored particles 325 may have a size of 500 nm, the third colored particles 320 may have a size of 800 nm, and the fourth colored particles 32D may have a size of 300 nm.

Moreover, in the present exemplary embodiment, it is assumed that the first colored particles 32A are colored yellow and positively charged, the second colored particles 32B are colored magenta and negatively charged, the third colored particles 32C are colored cyan and positively charged, and the fourth colored particles 32D are colored white and are not charged (alternatively almost not charged close to the negatively charged state). In addition, the charging polarities of particles are not limited to this combination, and the particles may have an optional polarity as long as a threshold value at which respective particles move are different from each other. Alternatively, all of the first, second, and third colored particles may be positively or negatively charged, and the fourth colored particles may be almost not charged close to the positively charged state.

Figure 2:
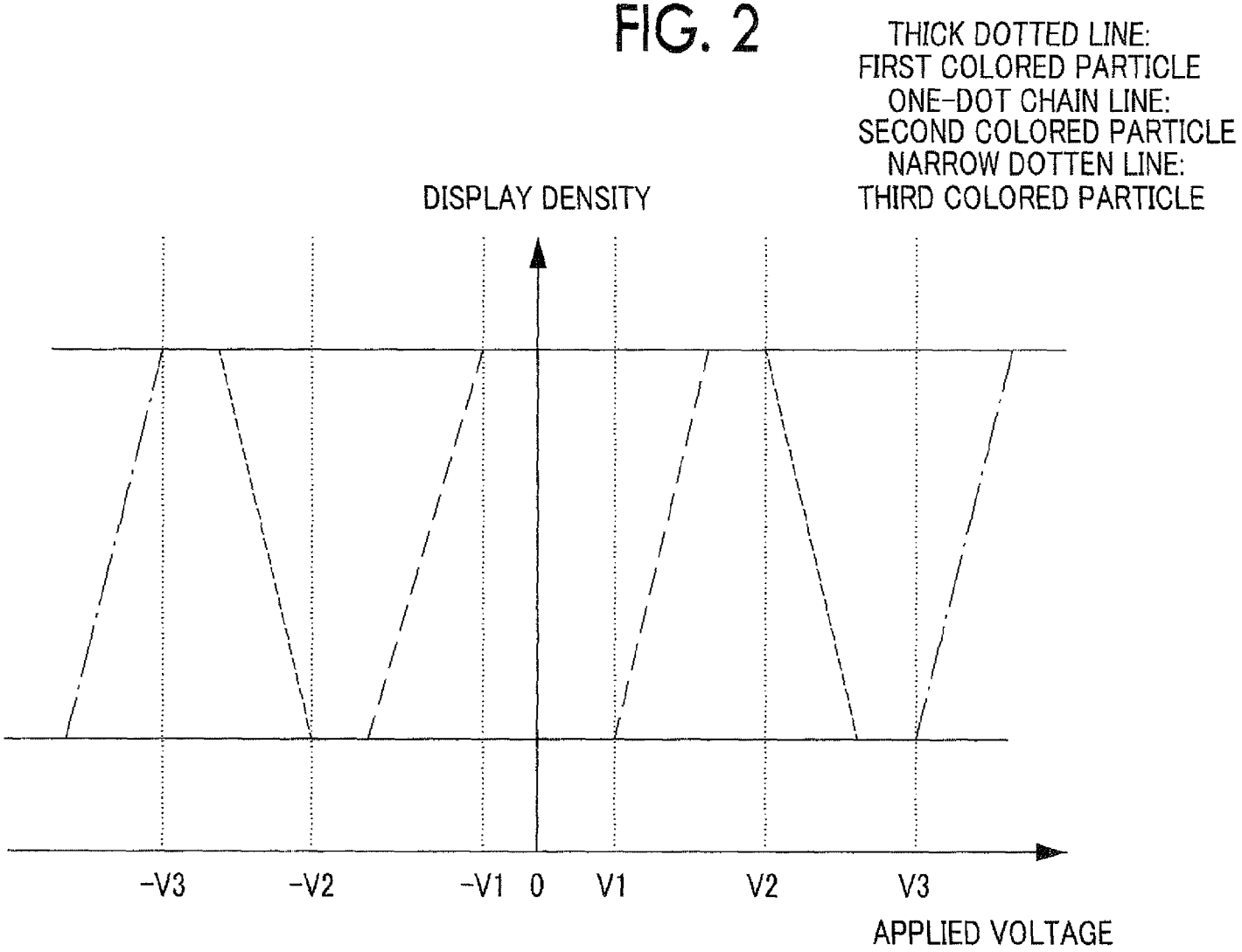
FIG. 2 is a diagram for explaining a threshold voltage necessary for moving respective colored particles in the image display device according to the first exemplary embodiment of the present invention.
Figure 3A:
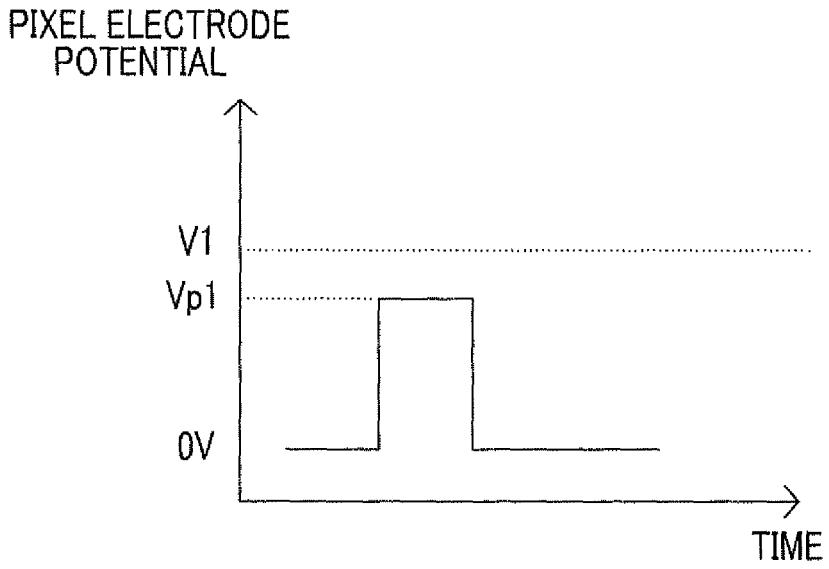
FIGS. 3A to 3D are diagrams for explaining a form of adjusting a voltage application period.
Figure 3B:
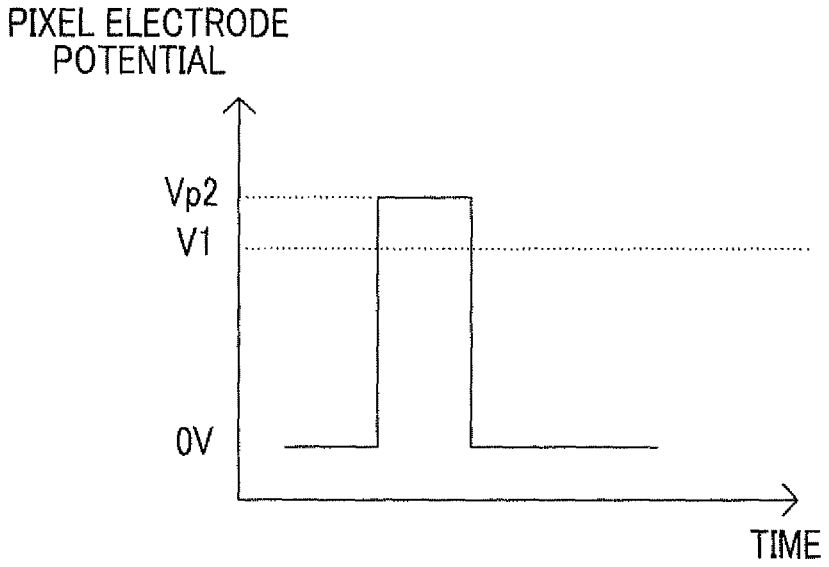
Figure 3C:
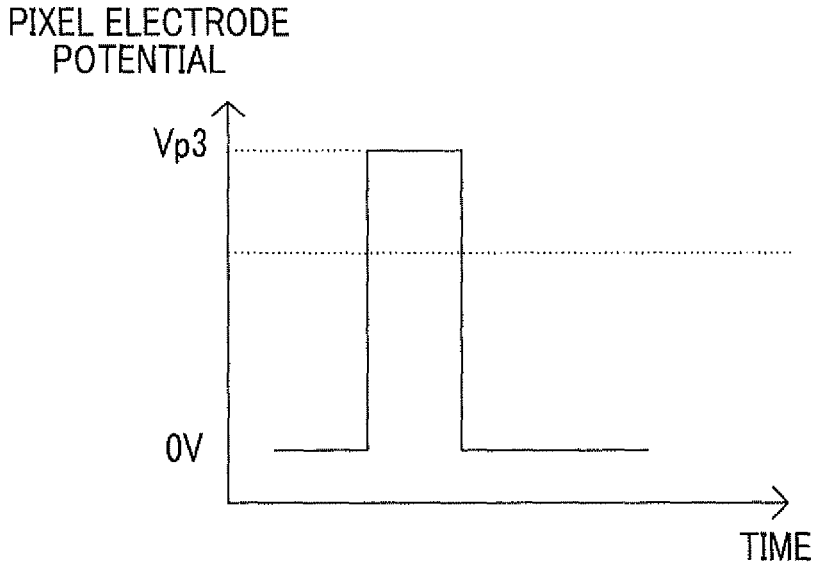
Figure 3D:
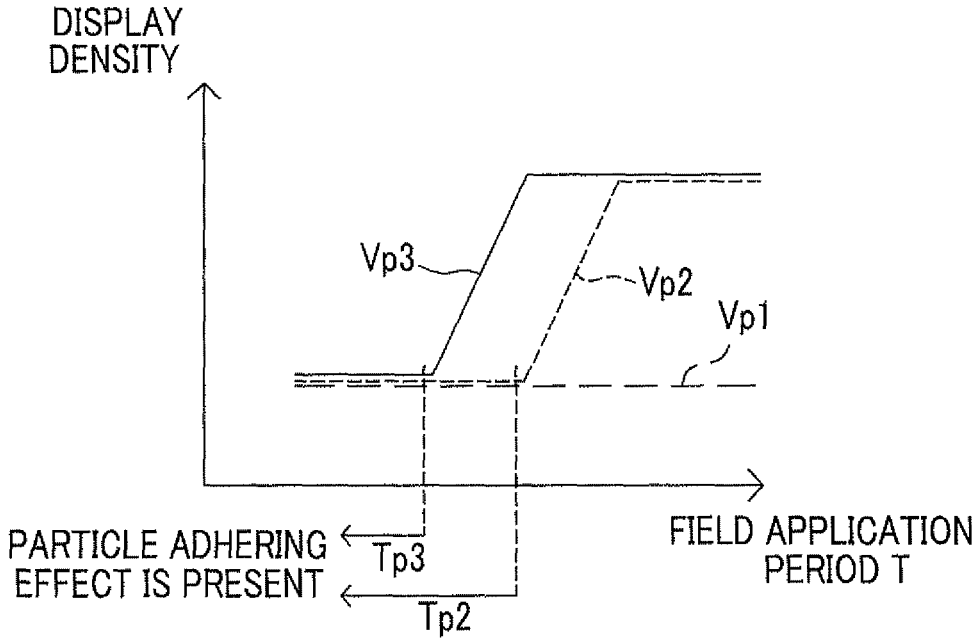

FIG. 2 is a diagram for explaining a threshold voltage necessary for moving the respective colored particles 32 in the image display device 10 according to the first exemplary embodiment of the present invention.

In the present exemplary embodiment, the respective charging characteristics of the respective colored particles 32 are different from each other. FIG. 2 shows the measurement results of optical density (OD) on the display surface side at each pulse voltage when the surface electrode 16 is grounded (0 V) and a pulse voltage is applied to the back electrode 22. The optical density is measured by a reflection densitometer (X-Rite 404) made by X-Rite while gradually changing the pulse voltage in an incremental manner (the applied voltage is increased or reduced).

In the present exemplary embodiment, the charging amounts and the particle diameters (volume average particle diameters) of the respective colored particles 32 are made different, so that the adhering force between the respective colored particles 32 and the surface layer 17 of the display substrate 18 is made different from the adhering force between the respective colored particles 32, and the moving start voltages of the first, second, and third colored particles 32A, 32B, and 320 are made different from each other. In addition, the display density characteristics of the respective colored particles 32 may be controlled by the difference in the adhering force described above and may be controlled by the difference in the mobility of the respective colored particles 32 in a separate manner.

In the present exemplary embodiment, when a voltage of |V1| or higher is applied, the first colored particles 32A start moving between the substrates. When a voltage of |V2| (V1<V2) or higher is applied, the second colored particles 32B start moving between the substrates. When a voltage of |V3| (V2<V3) or higher is applied, the third colored particles 320 start moving between the substrates. That is, the applied voltages are set to be within a different voltage range so that the ranges of voltages necessary of moving the respective colored particles 32 do not overlap, and the respective colored particles 32 have different charging characteristics.

On the other hand, the surface electrode 16 and the back electrode 22 are connected to the voltage applying unit 40. When the voltage applying unit 40 applies a voltage between the surface electrode 16 and the back electrode 22, an electric field is formed between the substrates.

The voltage applying unit 40 is connected to the controller 42, and the image storage unit 44 is connected to the controller 42. The controller 42 is configured to include a CPU, a ROM, a RAM, a hard disk, and the like, for example. The CPU performs image display on the image display medium 12 in accordance with a program that is stored in the ROM, the hard disk, or the like.

The image storage unit 44 may be a flash memory, a hard disk, or the like, and stores display images for displaying images on the image display medium 12. That is, the controller 42 controls the voltage applying unit 40 to apply a voltage between the substrates in accordance with a display image stored in the image storage unit 44, whereby the colored particles 32 move in accordance with the voltage and an image is displayed. In addition, the display image that is stored in the image storage unit 44 may also be downloaded to the image storage unit 44 via various recording media such as a CD-ROM or DVD or a network.

Moreover, as for the colored particles 32, the state when the voltage is applied is maintained by adhering force such as the van der Waals force or image force even after application of the voltage between the substrates has stopped, so that the colored particle 32 has the memory performance of images.

However, although the memory performance of images is maintained by the adhering force, the adhering force of the respective colored particles 32 to the substrate may decrease with the elapse of time due to an external factor such as vibration, whereby the memory performance decreases.

In the related art, a technique of maintaining the memory performance by applying the same voltage as the voltage used for writing an image is proposed. However, in the present exemplary embodiment, since plural groups of colored particles 32 having different threshold voltages necessary for moving the colored particles is used, it is necessary to apply voltages in a predetermined order for displaying respective colors in order to apply the same voltage as the writing voltage, which makes the operation complicated. Moreover, even when voltages are applied in order at the time of writing images, since images are rewritten every refresh period, the images are erased and then rewritten, it may not be said that the memory performance is maintained.

Therefore, in the present exemplary embodiment, rather than applying the same voltage as the voltage used for writing an image, the controller 42 controls the voltage applying unit 40 so as to apply a voltage every predetermined refresh interval such that the colored particles 32 adhered to the substrate are not separated and moved from the substrate and such that force is applied to a substrate to which at least one group of colored particles 32 (colored particles having the lowest threshold voltage necessary for moving in accordance with an electric field among the plural groups of colored particles 32) are adhered. In this way, the memory performance is augmented.

That is, when a voltage having such a magnitude and a polarity that the colored particles 32 adhered to a substrate are not separated and moved from the substrate is applied, although the colored particles 32 are not moved between the substrates, since force corresponding to an electric field is applied to the colored particles 32, the adhering force to the substrate is augmented. In this way, the memory performance is improved. Moreover, when a voltage having such a magnitude and a polarity that the colored particles 32 adhered to a substrate are not separated and moved from the substrate is applied, the adhering force toward the substrate, of not only the particles having the lowest threshold value but also particles having an optional threshold value is augmented. In this way, the memory performance toward the substrate in which particles are disposed is improved.

In the present exemplary embodiment, the electric field that augments the adhering force of colored particles will be referred to a particle adhering field. Although the memory performance of particles is naturally improved when the particle adhering field is applied toward the particles positioned on the display substrate, when the particle adhering field is applied to a back-side substrate, the generation of image noise due to floating particles becomes unnecessary for display may be suppressed. Thus, the memory performance of an image that is to be displayed is improved. Moreover, the adhering of particles may be facilitated sufficiently by increasing the application period of the particle adhering field as long as the particle adhering field has such a magnitude that the colored particles are not separated from the substrate. In this way, it is possible to improve the memory performance.

In addition, the electric field at which the colored particles 32 adhered to the substrate are not separated and moved from the substrate may be realized by decreasing the duration of applied pulses rather than decreasing the magnitude of the electric field. For example, the pulse duration may be shorter than a period in which the particles adhered to the substrate are separated from the substrate. That is, in the exemplary embodiment of the present invention, a voltage applying unit is controlled by adjusting the voltage application period as well as the magnitude of the voltage so that a voltage has a threshold voltage lower than any one of the threshold voltages of the colored particles present on one substrate, and force is applied to the other substrate side.

Figure 4A:
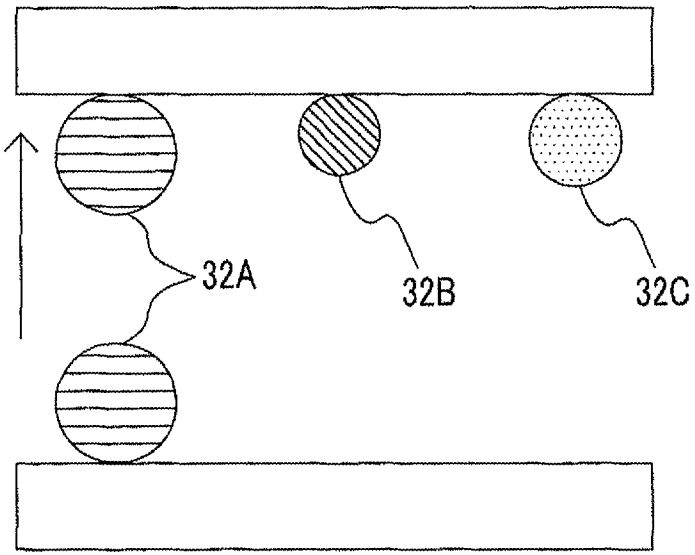
FIGS. 4A and 4B are diagrams showing an example of a particle adhering field in the form of adjusting a voltage application period.
Figure 4B:
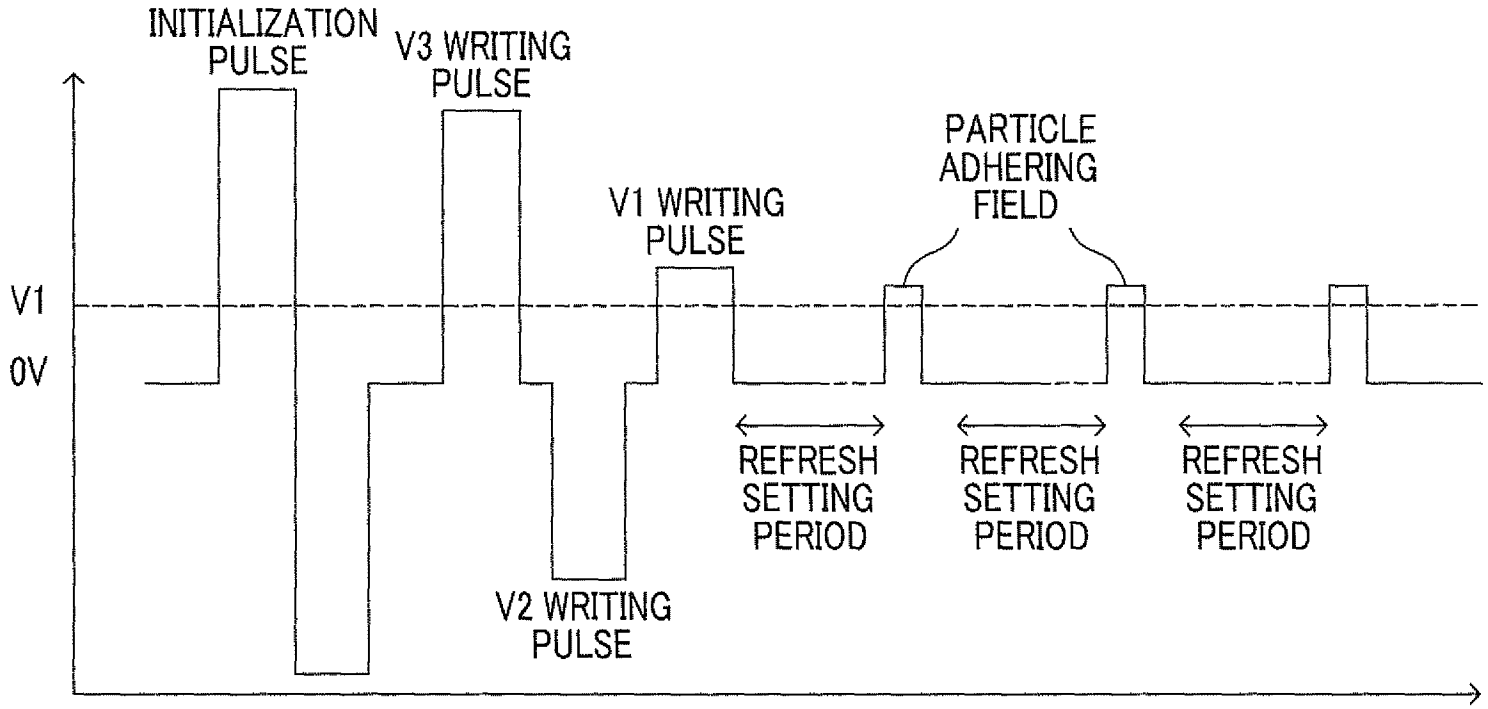

In FIGS. 3A to 3D, a change in the display density due to a movement of particles when a certain voltage pulse (for example, voltage application period: 1 second) is applied is measured, and a voltage at which the colored particles 32A start moving is a threshold voltage V1. However, the movement of particles does not depend on only the threshold voltage but depends on a voltage application period. When a voltage Vp1 lower than V1 and voltage Vp2 and Vp3 higher than V1 (Vp1<V1<Vp2<Vp3) are applied to the colored particles 32A having a threshold voltage V1 for a voltage application period of 1 second (FIGS. 3A to 3C), the relation between a voltage application period and the display density of the colored particle 32A is measured and shown in FIG. 3D while changing the voltage application period T of the voltage Vp1, Vp2 and Vp3. For the applied voltage Vp1 lower than V1, the movement of display particles does not occur and the display density is low regardless of the voltage application period. For the applied voltage Vp2 higher than V1, the separation and movement of particles from the substrate do not occur when the voltage application period T is short, and the movement of particles starts when the voltage application period T=Tp2. For the applied voltage Vp3 higher than Vp2, similarly, the separation and movement of particles from the substrate do not occur when the voltage application period T is short, and the movement of particles starts when the voltage application period T=Tp3. (in this case, Tp3<Tp2<1 second). For the applied voltage Vp2, since the movement of particles does not occur if the voltage application period is Tp2 or shorter, the voltage Vp2 may act as the particle adhering field if the voltage application period is shorter than Tp2. Similarly, for the applied voltage Vp3, the voltage Vp3 may act as the particle adhering field if the voltage application period is Tp3 or shorter. That is, a particle adhering field of the pulse voltages as shown in FIGS. 4A and 4B may be applied.

Here, a specific method of applying voltages for improving the memory performance will be described in detail with reference to FIGS. 5A to 10B. In the respective diagrams, the fourth colored particles are not illustrated in the arrangement diagram of colored particles for the sake of convenience. Moreover, although the adhering state of respective particles is expressed by one or two particles, actually, a number of respective particles are arranged in lines or in a layered form.

Figure 5A:
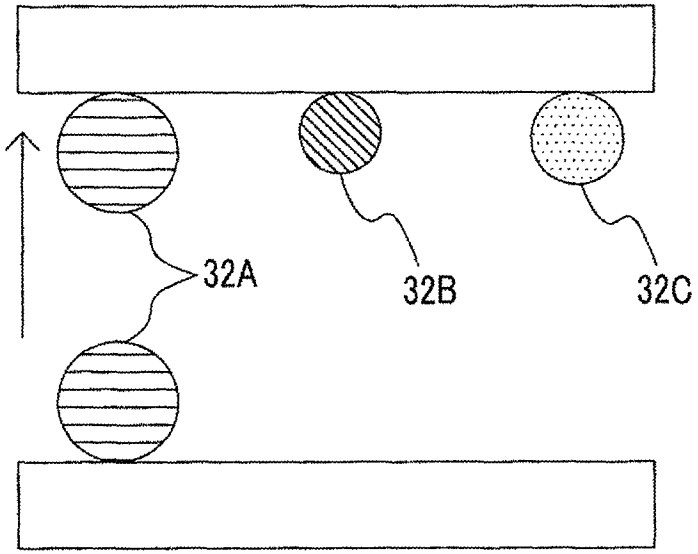
FIGS. 5A and 5B are diagrams showing an example of a voltage applied to improve a memory performance when first colored particles are present on both a display substrate side and a back substrate side after an image is written in the image display device according to the first exemplary embodiment of the present invention.
Figure 5B:
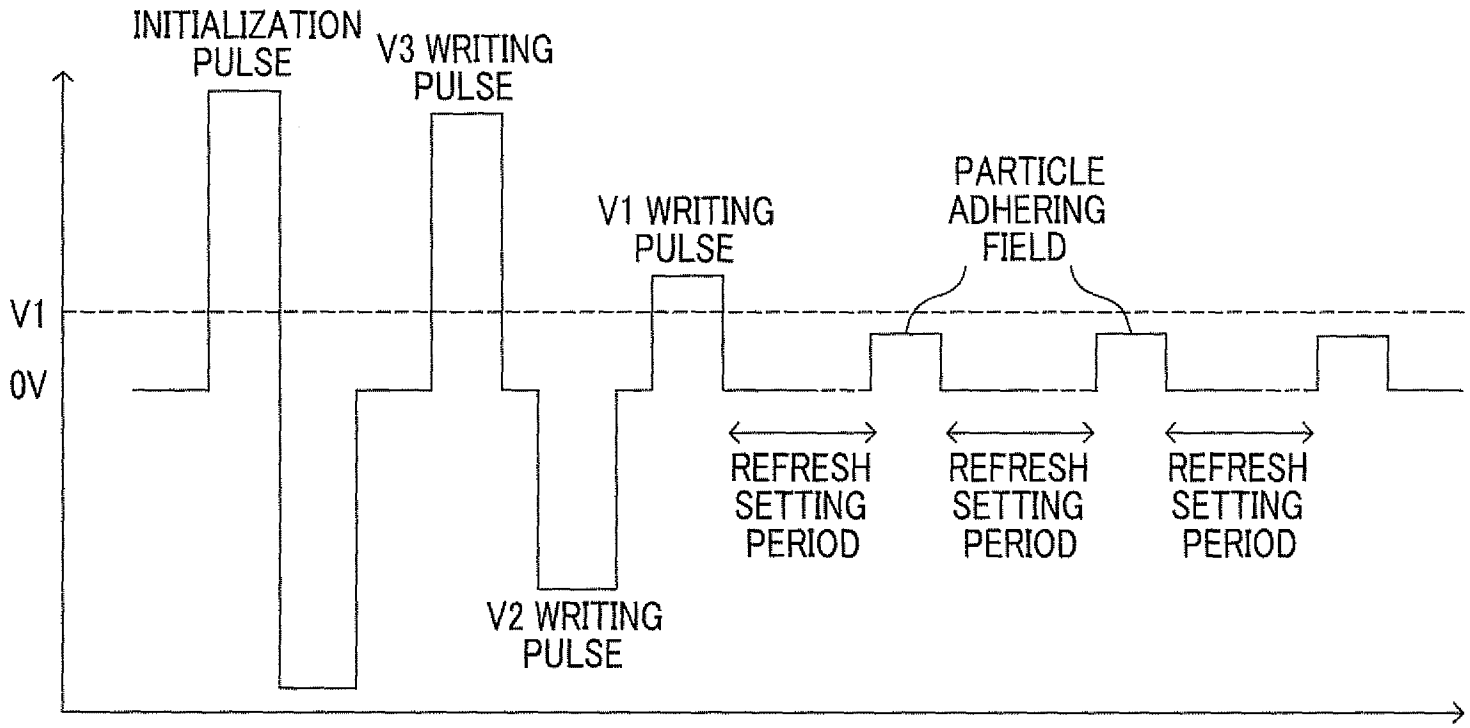

FIGS. 5A and 5B are diagrams showing an example of a voltage applied to improve a memory performance when the first colored particles 32A are present on both the display substrate 18 side and the back substrate 28 side after an image is written in the image display device according to the first exemplary embodiment of the present invention. FIG. 5B shows a voltage applied to the back electrode 22 when the surface electrode 16 is grounded (0 V).

In FIGS. 5A and 513, an image is written based on image information so that the first colored particles 32A are present on the display substrate 18 side and the back substrate 28 side so that a yellow halftone image is displayed). Specifically, predetermined positive and negative initialization pulses (>V3) are applied, whereby colored particles 32 are arranged, and a writing pulse corresponding to image information is applied. Subsequently, in the example of FIG. 5B, pulse voltages corresponding to image information are applied in the order of a positive V3 writing pulse voltage for moving the third colored particles 32C, a negative V2 writing pulse voltage for moving the second colored particles 32B, and a positive V1 writing pulse voltage for moving the first colored particles 32A. In this way, an image is written so that the first colored particles 32A are present on both the display substrate 18 side and the back substrate 28 side, as shown in FIG. 5A.

The moving amount of colored particles may be controlled by appropriately selecting the magnitude of a writing pulse voltage or a voltage pulse application period.

Moreover, whenever a predetermined refresh setting period has elapsed after the image is written, a pulse voltage (particle adhering field) having such a magnitude that the first colored particles 32A having the lowest threshold voltage among the plural colored particles 32 do not move is applied. In FIGS. 5A and 5B, although a positive particle adhering field is applied, a negative particle adhering field may be applied.

That is, since the voltage applied whenever the refresh setting period has elapsed is a pulse voltage (particle adhering field) having such a magnitude that the first colored particles 32A are not separated and moved from the substrate, the first colored particles 32A as well as the other colored particles 32 do not move between the substrates. However, since the particle adhering field applies force that causes the first colored particles 32A having the lowest threshold voltage and the highest mobility to adhere to the substrate, the adhering force is augmented. In this way, the memory performance of images is improved. For example, as shown in FIG. 5B, when a pulse voltage lower than the positive voltage V1 is applied to the back electrode 22, force is applied to the display substrate 18 side, the adhering force toward the display substrate 18, of the first colored particles 32A having the lowest threshold voltage is augmented by the force generated by the applied pulse voltage although the colored particles 32 are not moved. In this way, the memory performance is improved.

Figure 6A:
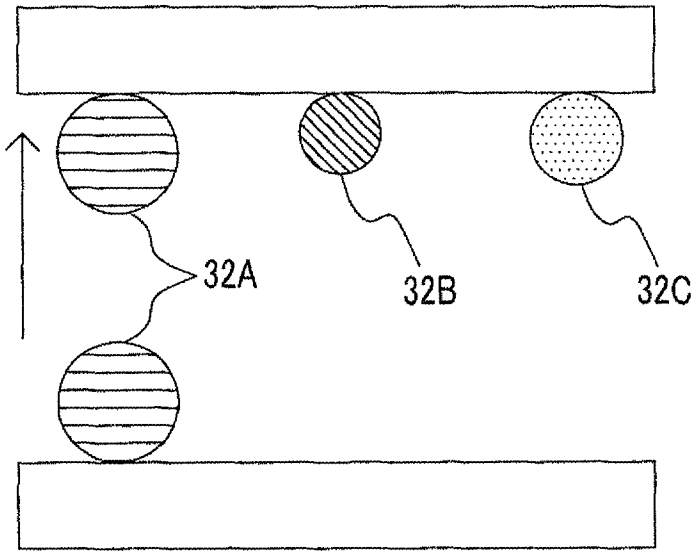
FIGS. 6A and 6B are diagrams showing another example of a voltage applied to improve a memory performance when first colored particles are present on both a display substrate side and a back substrate side after an image is written in the image display device according to the first exemplary embodiment of the present invention.
Figure 6B:
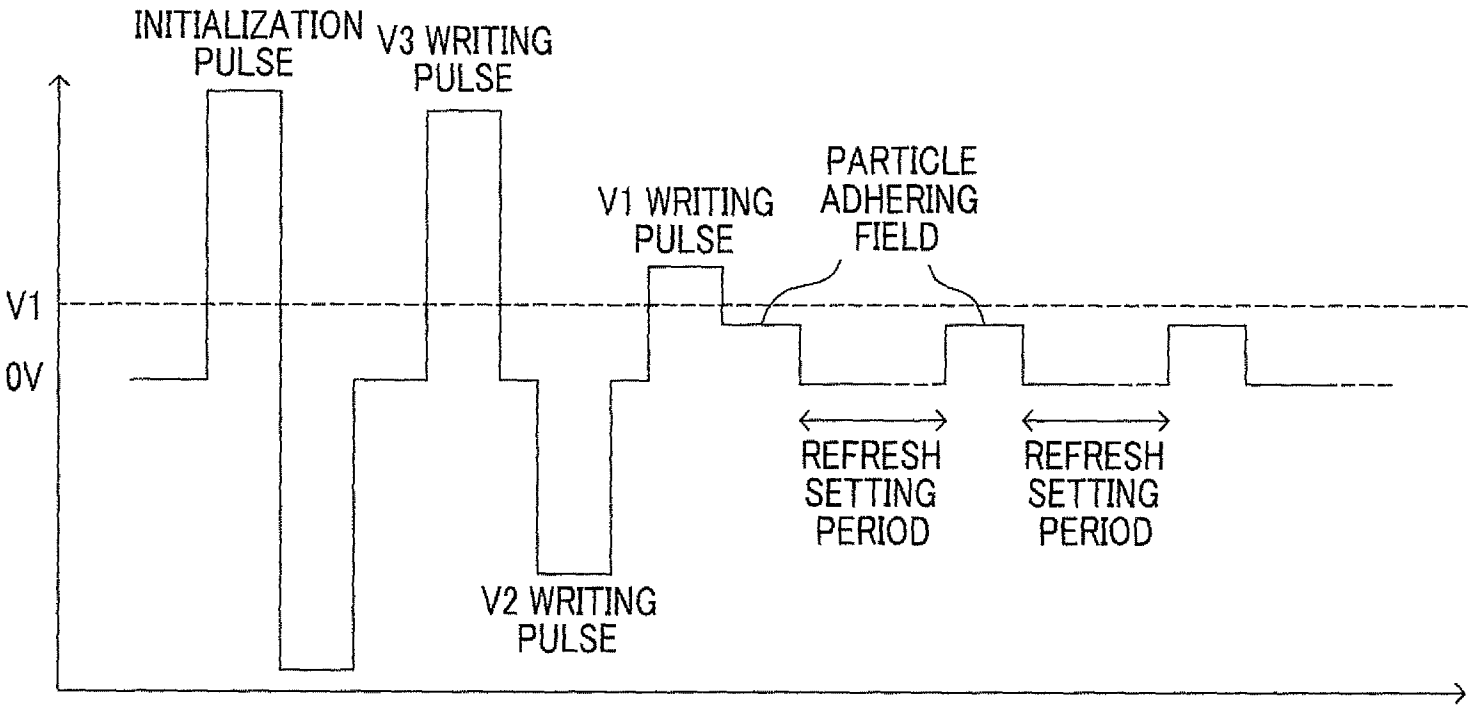

In FIG. 5B, the particle adhering field is applied after the elapse of the refresh setting period after an image is written (the V1 writing pulse is applied). However, as shown in FIGS. 6A and 6B, the particle adhering field may be applied immediately after an image is written, and then, similarly to FIG. 5B, the particle adhering field may be applied whenever the refresh setting period has elapsed. When the particle adhering field is applied continuous to a writing pulse to particles which have moved by the V1 writing pulse, the particle adhering field is sufficiently applied, a small number of particles will be likely to be separated from the substrate. Thus, it is expected that a sufficient memory performance is obtained.

Moreover, it is expected that the necessary refresh interval immediately after writing an image may be increased.

Figure 7A:
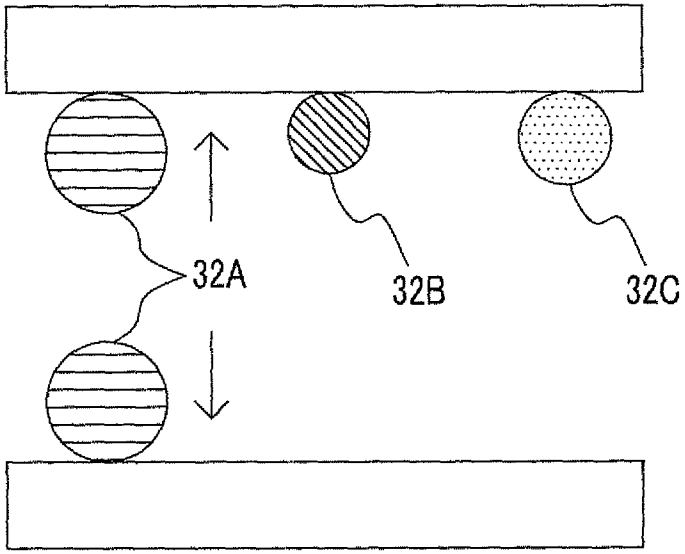
FIGS. 7A and 7B are diagrams showing a modification example of a voltage applied to improve a memory performance when first colored particles are present on both a display substrate side and a back substrate side after an image is written in the image display device according to the first exemplary embodiment of the present invention.
Figure 7B:
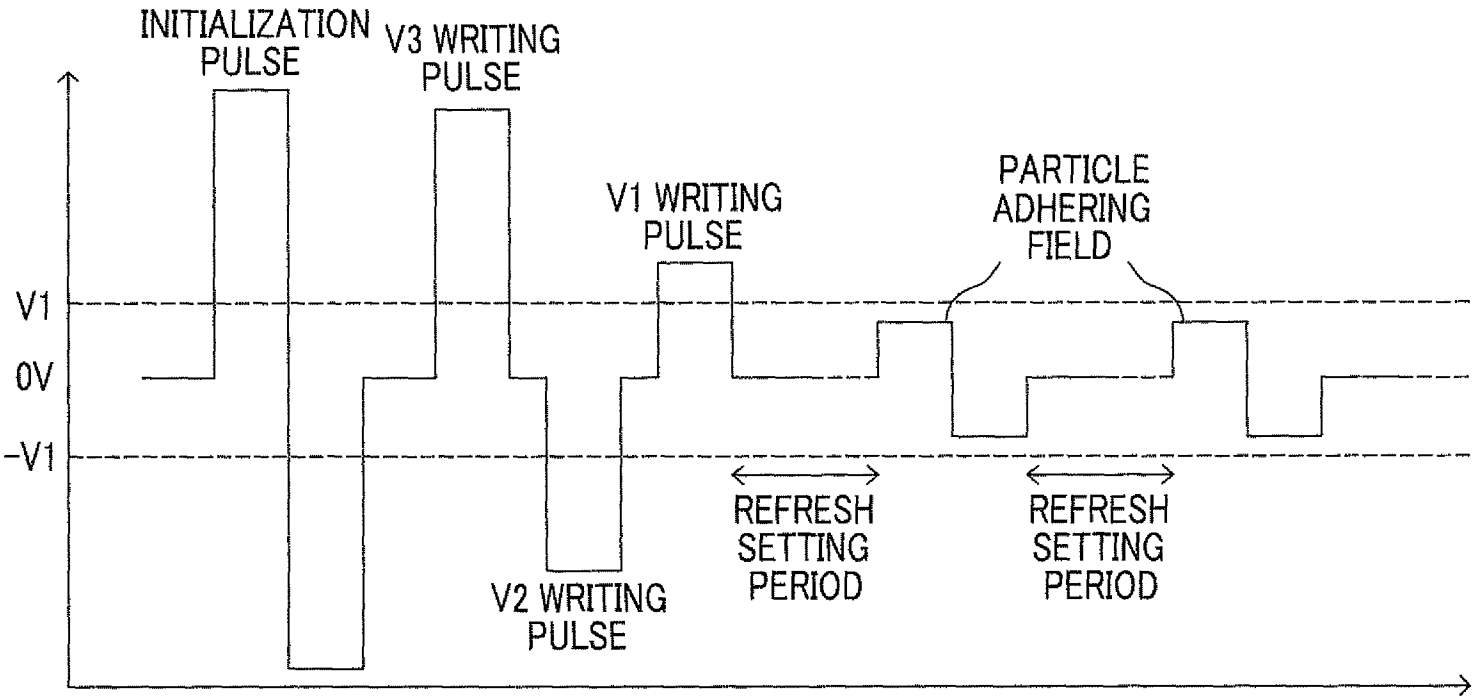

FIGS. 7A and 7B are diagrams showing a modification example of a voltage applied to improve a memory performance when the first colored particles 32A are present on both the display substrate 18 side and the back substrate 28 side after an image is written in the image display device according to the first exemplary embodiment of the present invention.

In FIGS. 7A and 7B, an image is also written so that a yellow halftone image is displayed. Writing of images is performed in a manner similar to the above so as to create a state where the first colored particles 32A are present on both the display substrate 18 and the back substrate 28 as shown in FIG. 7A.

Moreover, whenever a predetermined refresh setting period has elapsed after the image is written, a pulse voltage (particle adhering field) having such a magnitude that the first colored particles 32A having the lowest threshold voltage among the plural colored particles 32 do not move is applied. In the above example, although a positive or negative particle adhering field is applied, positive and negative particle adhering fields are alternately applied in FIG. 7B.

That is, in the example of FIGS. 5A and 5B, force that augments the adhering force to the substrate is applied to the first colored particles 32A present on the display substrate 18 side or the back substrate 28 side. In the modification example of FIGS. 7A and 7B, since positive and negative pulse voltages are alternatively applied, force that augments the adhering force toward the substrate is applied to the first colored particles 32A present on both the display substrate 18 side and the back substrate 28 side rather than only the first colored particle 32A present on one substrate side. Thus, the memory performance of images is further improved than the case of FIGS. 5A and 5B.

Figure 8A:
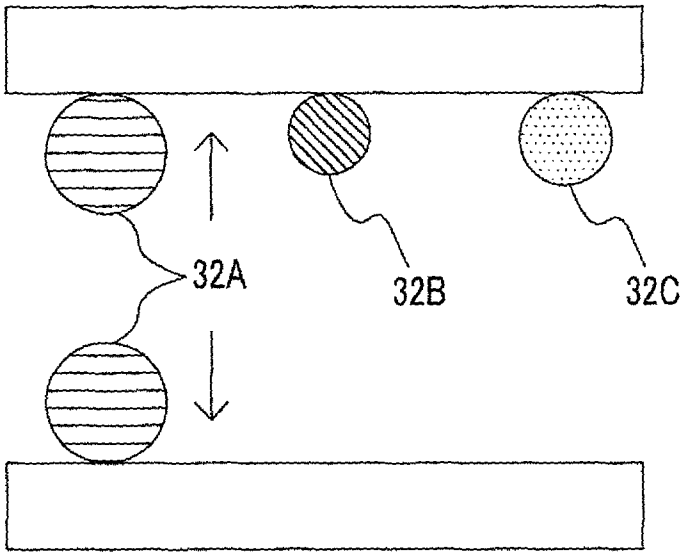
FIGS. 8A and 8B are diagrams showing another modification example of a voltage applied to improve a memory performance when first colored particles are present on both a display substrate side and a back substrate side after an image is written in the image display device according to the first exemplary embodiment of the present invention.
Figure 8B:
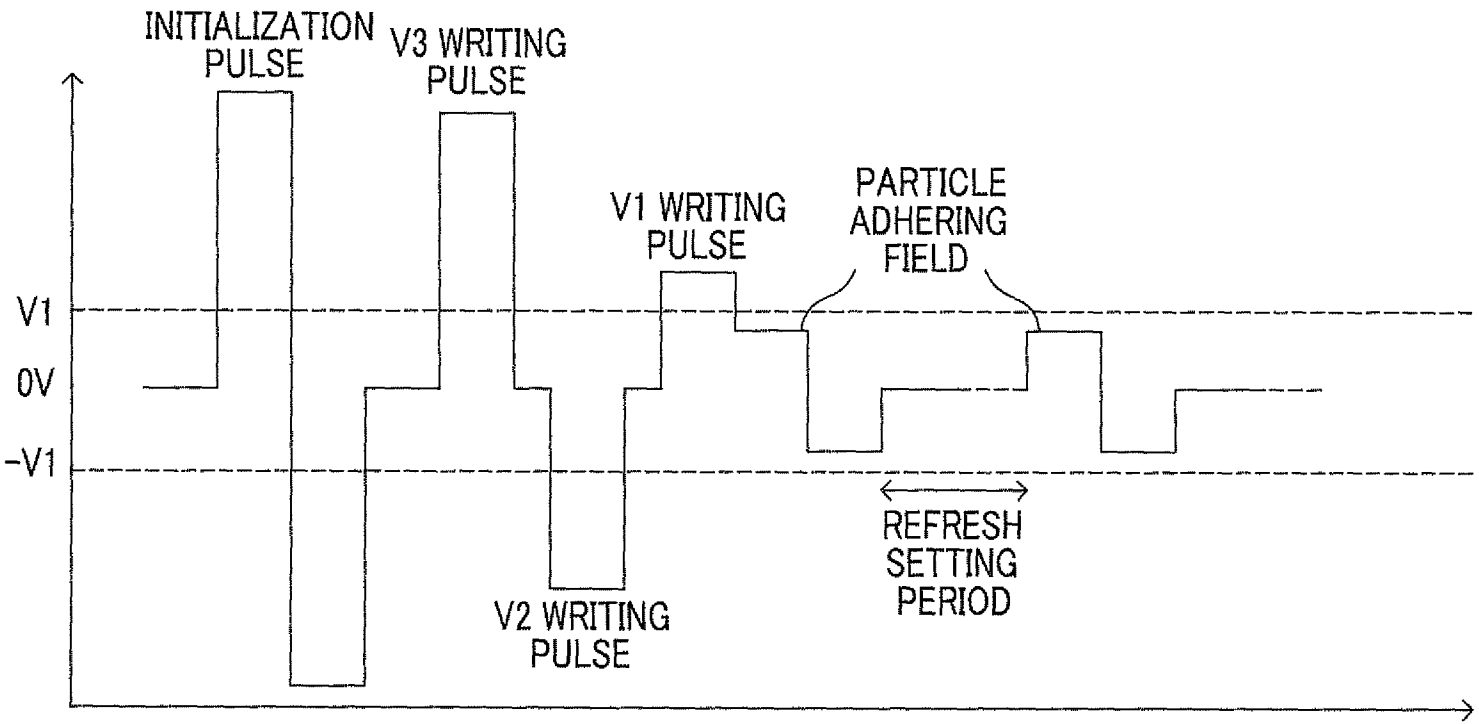

Moreover, as shown in FIGS. 8A and 8B, when the particle adhering field is applied continuous to the V1 writing pulse toward the display surface side and the back surface side substrates, particles which are not sufficiently adhered to the substrate may be arranged to be sufficiently adhered to the surface and back substrates. Thus, it is expected that a sufficient memory performance is obtained. Moreover, it is expected that the necessary refresh interval immediately after writing an image may be increased.

Figure 9A:
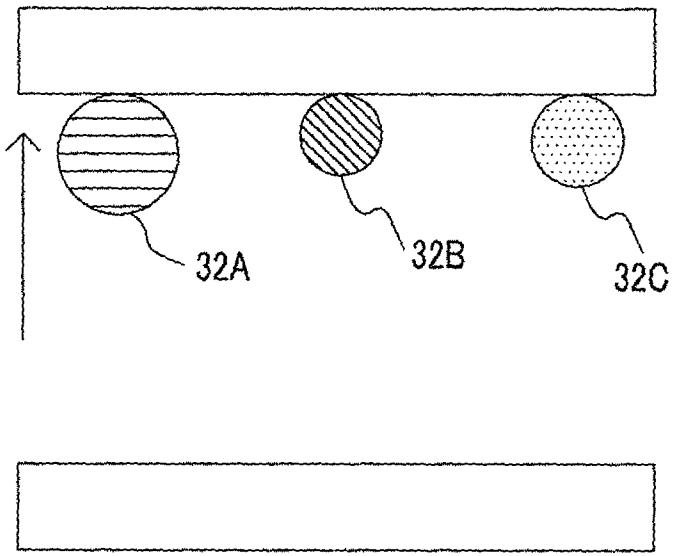
Figure 9B:
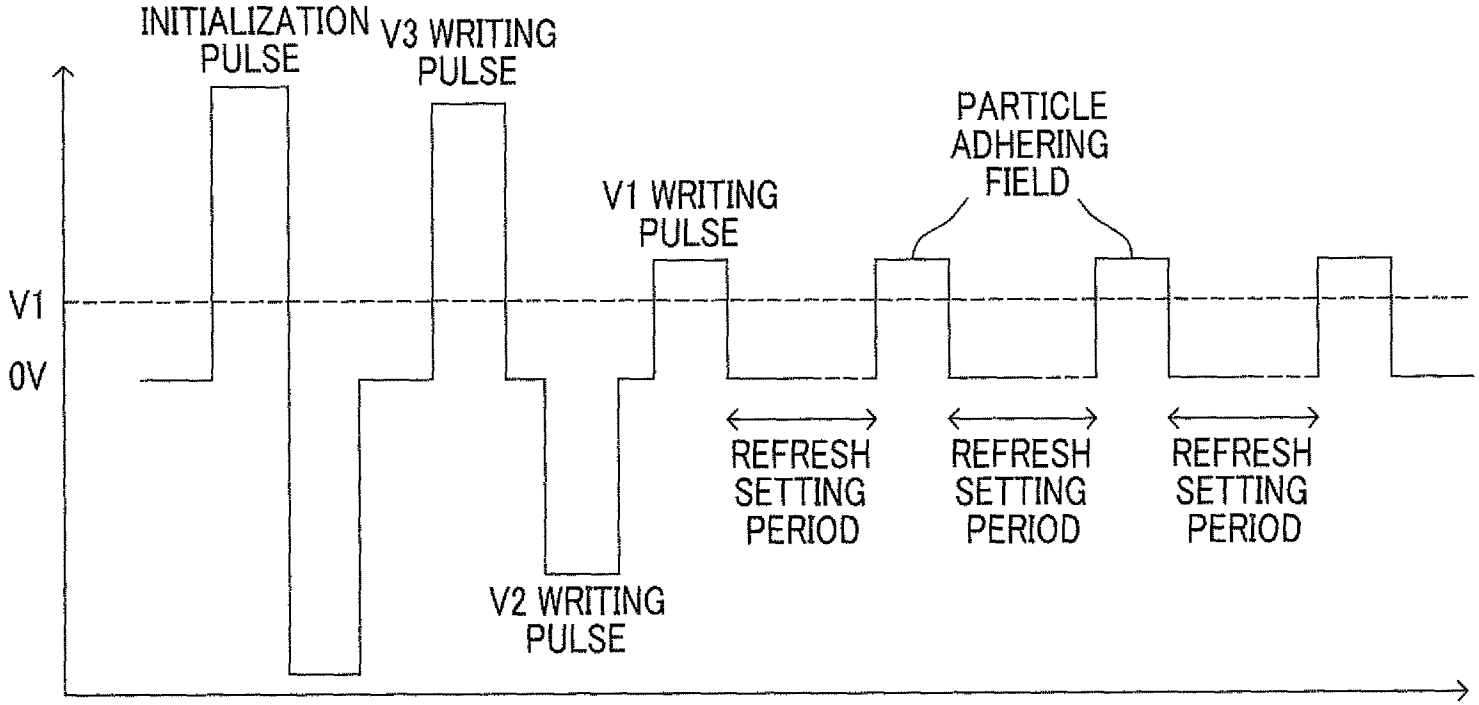

FIGS. 9A and 9B are diagrams showing an example of voltage applied to improve a memory performance when all (or a majority part) of the first colored particles 32A are moved to the display substrate 18 side after an image is written in the image display device according to the first exemplary embodiment of the present invention.

In FIGS. 9A and 9B, an image is written based on image information so that all (or a majority part) of the first colored particles 32A are moved toward the display substrate side. Writing of images is performed such that the predetermined positive and negative initialization pulses (>V3) are applied, whereby colored particles 32 are arranged, and a writing pulse corresponding to image information is applied. Subsequently, in the example of FIGS. 9A and 9B, pulse voltages corresponding to image information are applied in the order of a positive V3 writing pulse voltage for moving the third colored particles 32C, a negative V2 writing pulse voltage for moving the second colored particles 32B, and a positive V1 writing pulse voltage for moving the first colored particles 32A. In this way, an image is written so that all (or a majority) of the first colored particles 32A are moved to the display substrate 18 side, as shown in FIG. 9A.

Moreover, whenever a predetermined refresh setting period has elapsed after the image is written, a pulse voltage having the same magnitude and polarity as the V1 writing pulse is applied as a particle adhering field. That is, since all of the first colored particles 32A having the lowest threshold voltage among the plural colored particles 32 are moved to the display substrate 18 side, even when a voltage having the same polarity as the image writing voltage and a magnitude higher than a voltage for moving the first colored particles 32A is applied if the voltage is lower than the voltage for moving the second colored particles 32B, the colored particles 32 are not separated from the substrates and moved between the substrates. Therefore, the same pulse voltage as that used for writing an image is applied.

As a result, the colored particles 32 as well as the other colored particles 32 do not move between the substrates. The particle adhering field applies force that causes the first colored particles 32A having the lowest threshold voltage and the highest mobility to adhere to the substrate. Thus, the memory performance of images is augmented.

Figure 10A:
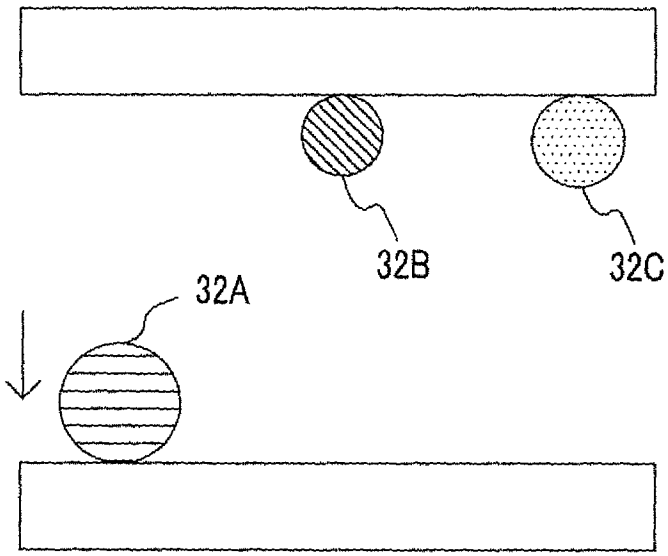
FIGS. 10A and 10B are diagrams showing an example of a voltage applied to improve a memory performance when all (or a majority part) of first colored particles are moved to a back substrate side after an image is written in the image display device according to the first exemplary embodiment of the present invention.
Figure 10B:
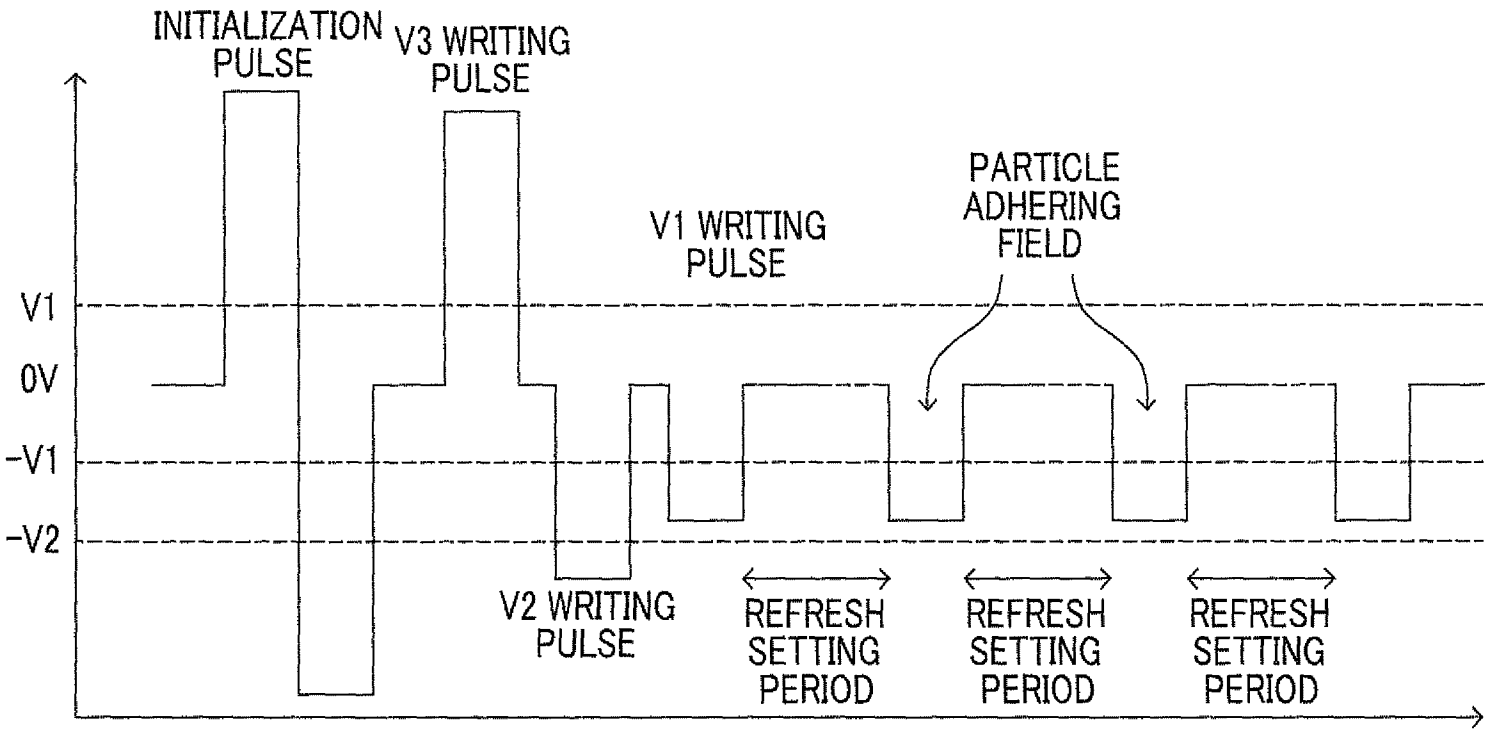

Although writing of images is performed so that the first colored particles 32A are moved toward the display substrate 18 side in FIG. 9B, when writing of images is performed so that the first colored particles 32A are moved toward the back substrate 28 side as shown in FIG. 10A, a negative particle adhering field may be applied similarly to the V1 writing pulse as shown in FIG. 10B.

Moreover, when all (or a majority part) of the first colored particles 32A are moved toward the display substrate 18 side, and all (or a majority part) of the second colored particles 32B are moved toward the back substrate 28 side, even when a positive pulse voltage higher than V2 and lower than V3 is applied, the colored particles 32 do not move between the substrates. In this case, a positive pulse voltage higher than V2 and lower than V3 may be applied. Moreover, when all (or a majority part) of the first colored particles 32A are moved toward the back substrate 28 side, and all (or a majority part) of the second colored particles 32B are moved toward the display substrate 18 side, a negative pulse voltage higher than V2 and lower than V3 may be applied.

Moreover, when all (or a majority part) of the first and third colored particles 32A and 32C are moved toward the display substrate 18 side, and all (or a majority part) of the second colored particles 32B are moved toward the back substrate 28 side, even when a positive pulse voltage higher than V3 is applied, the colored particles 32 do not move between the substrates. In this case, a positive pulse voltage higher than V3 may be applied. Moreover, when all (or a majority part) of the first and third colored particles 32A and 32C are moved toward the back substrate 28 side, and all (or a majority part) of the second colored particles 32B are moved toward the display substrate 18 side, a negative pulse voltage higher than V3 may be applied.

As above, even when a voltage is applied such that the colored particles 32 are not separated and moved from the substrate and such that force is applied to a substrate to which at least one group of colored particles 32 (the first colored particles 32A having the lowest threshold voltage necessary for moving in accordance with an electric field among the plural groups of colored particles 32) are adhered, since force corresponding to the applied electric field may be applied to the colored particles 32 although the colored particles 32 are not moved between the substrates, the memory performance of the colored particles 32 having the low moving threshold value is improved.

Therefore, when the controller 42 determines a pulse voltage and the polarity thereof, having such a magnitude that the colored particles 32 are not separated and moved from the substrate based on the last image information used for writing images after controlling the imaging writing operation and controls the voltage applying unit 40 so as to apply the determined pulse voltage every predetermined refresh period between the substrates, the memory performance of the image display device 10 is improved.

Figure 11:
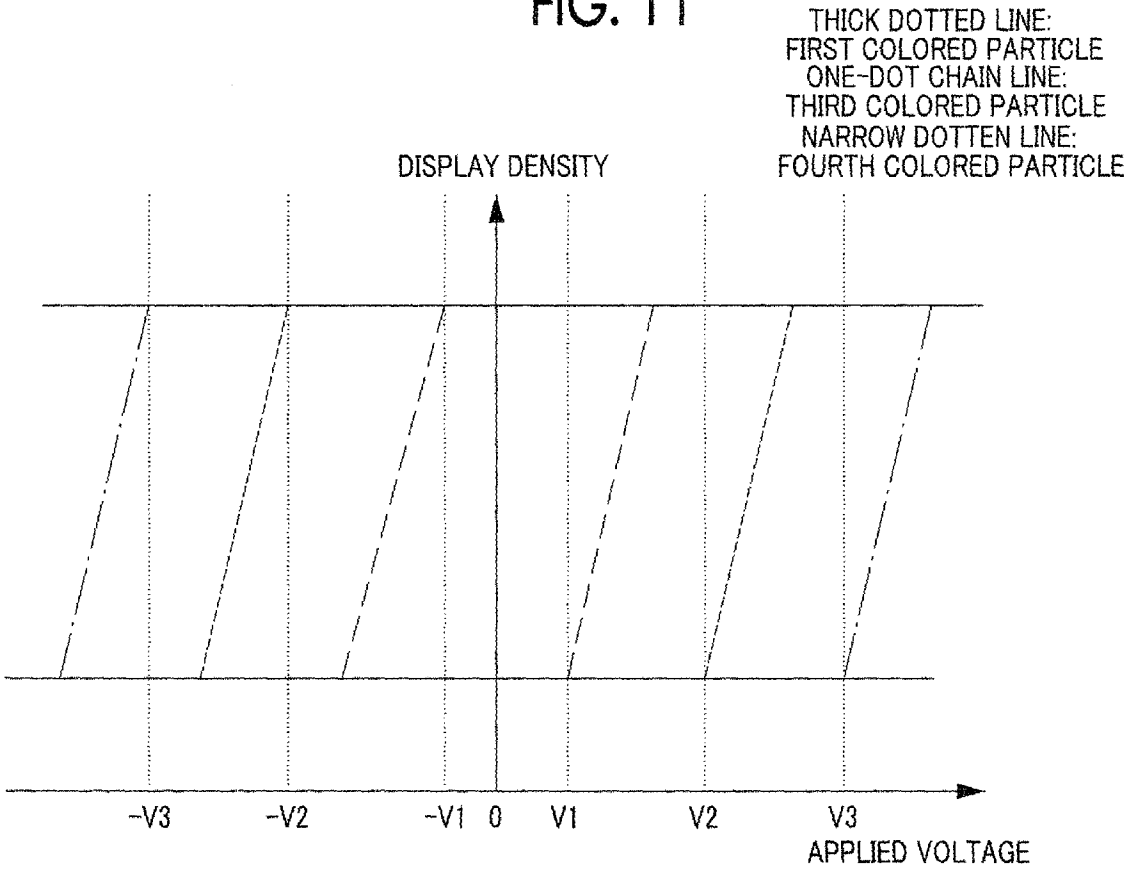
FIG. 11 is a diagram showing another example of a threshold voltage necessary for moving respective colored particles.

In addition, in the exemplary embodiment, although the first and third colored particles 32A and 32C have charging characteristics of the same polarity and the second colored particles 3213 have charging characteristics of a polarity opposite to those of the first and third colored particles 32A and 32C, the polarities are not limited to this. For example, as shown in FIG. 11, all of the colored particles 32 may have the same polarities and have different moving threshold voltages.

(Second Exemplary Embodiment)

Figure 12:
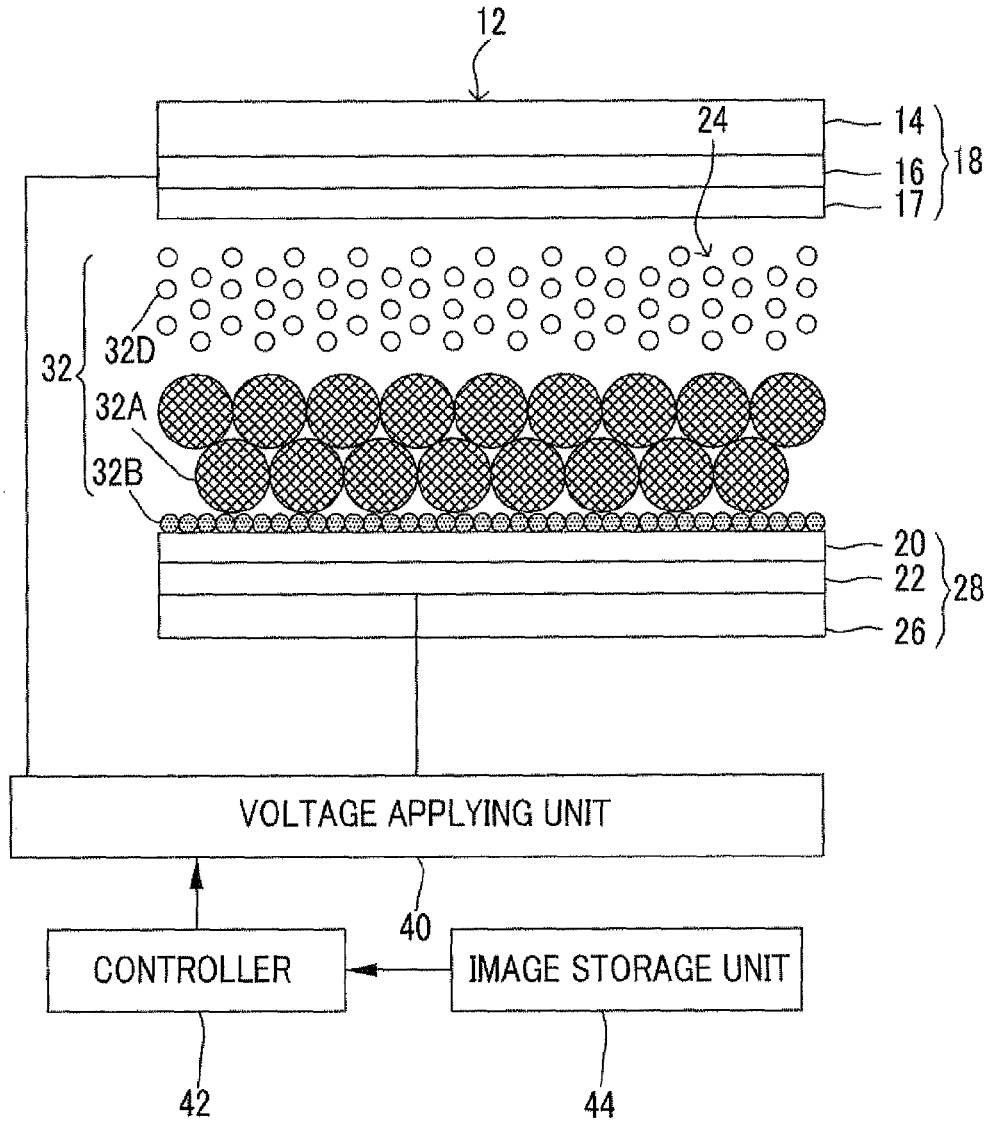
FIG. 12 is a schematic configuration diagram showing an image display device according to a second exemplary embodiment of the present invention.

Next, an image display device according to a second exemplary embodiment will be described. FIG. 12 is a schematic configuration diagram showing an image display device according to the second exemplary embodiment of the present invention. FIG. 12 shows an example where a white image is displayed. The same configuration as the first exemplary embodiment will be denoted by the same reference numerals.

In the first exemplary embodiment, four groups of colored particles 32 (three groups of colored particles moving in accordance with an electric field and floating colored particles) are enclosed. In the second exemplary embodiment, three groups of colored particles 32 (the first, second, and fourth colored particles 32A, 32B, and 32D) fewer by one than the first exemplary embodiment are enclosed.

The first colored particles 32A may be filled such that one layer each is arranged between the display substrate 18 and the back substrate 28 as described in the above exemplary embodiment. However, it is preferable to fill the first colored particles 32A such that plural layers may be disposed between the substrates since higher concealing ability is obtained. In this case, when the size of the first colored particles 32A increases, the distance between the substrates increases, the display driving voltage increases, and the display switching speed decreases. Thus, the size of the first colored particles 32A is preferably 50 μm or less, and more preferably, 30 μm or less.

Moreover, the particle size of the first colored particles 32A is set such that the second and fourth colored particles 32B and 32D may move through the gaps between the first colored particles in a state where the first colored particles clump together (a state where an electric field is applied between the substrates, and the first colored particles move toward the respective substrates and clump together). Specifically, the size of the first colored particles 32A is preferably at least 5 times the size of the other colored particles, and more preferably, at least 10 times when a variation of the particle sizes of the respective colored particles is taken into consideration. Moreover, the moving speed (mobility) of the first colored particles 32A is preferably at most ½ of the moving speed of the other colored particles, and more preferably at most ⅕ of that.

Moreover, although higher resolution image display may be achieved with the smaller size of the other colored particles (the second and fourth colored particles 32B and 32D) other than the first colored particles 32A, it is desirable for the size of the other colored particles to be 20 nm or more and 10 μm or less because the moving velocity decreases and the display switching speed decreases and because it becomes difficult to achieve a balance between memory performance of the display and the stability of dispersion.

As examples of the sizes of the respective colored particles 32, the first colored particles 32A may have a size of 10 μm, the second colored particles 32B may have a size of 500 nm, and the fourth colored particles 32D may have a size of 300 nm.

Moreover, in the present exemplary embodiment, it is assumed that the first colored particles 32A are colored red and positively charged, the second colored particles 32B are colored black and negatively charged, and the fourth colored particles 32D are colored white and are not charged (alternatively almost not charged close to the negatively charged state).

Figure 13:
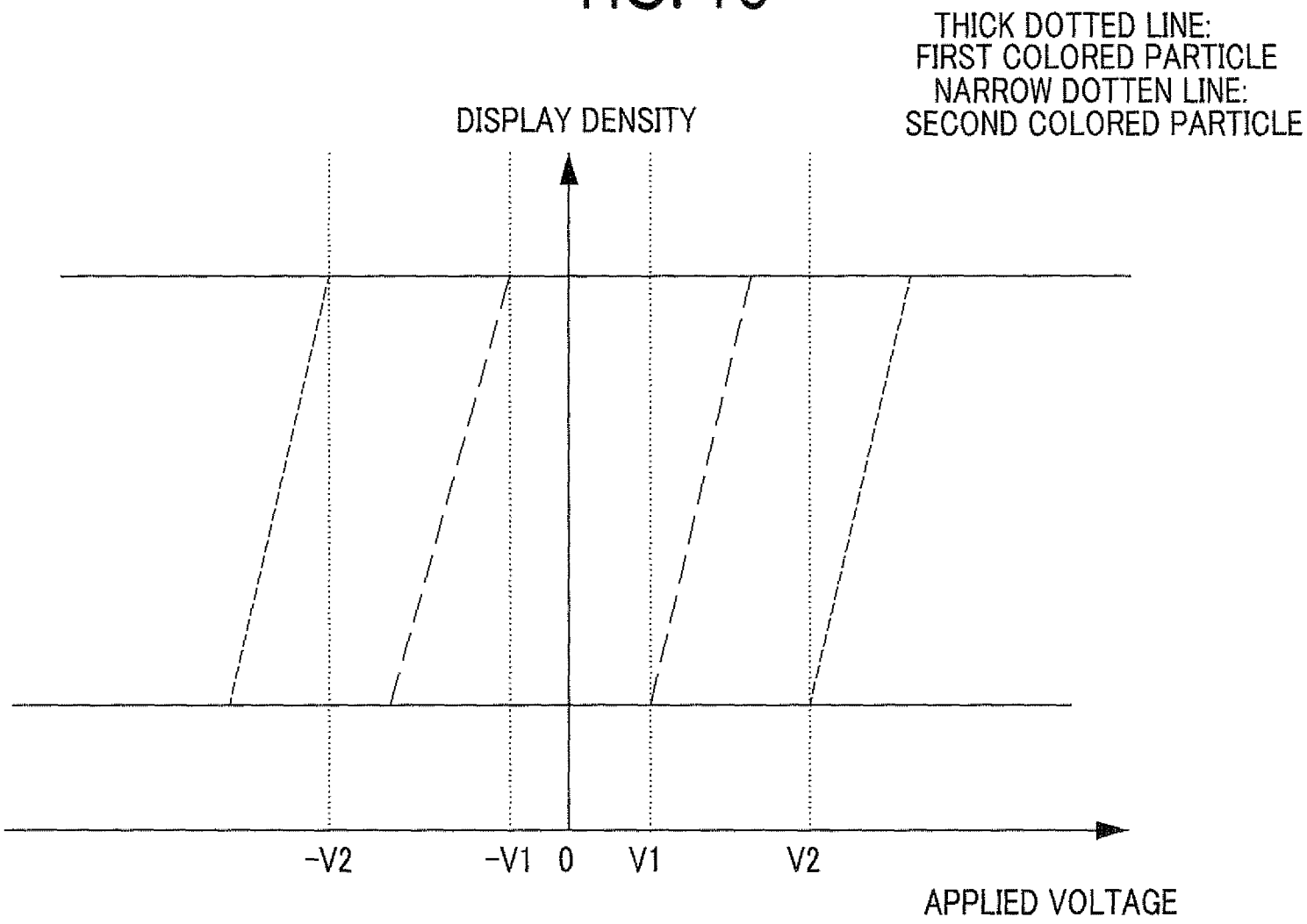
FIG. 13 is a diagram for explaining a voltage applied to move respective colored particles in the image display device according to the second exemplary embodiment of the present invention.

FIG. 13 is a diagram for explaining a necessary voltage applied to move the respective colored particles 32 in the image display device according to the second exemplary embodiment of the present invention.

In the present exemplary embodiment, the respective charging characteristics of the respective colored particles are different from each other similarly to the first exemplary embodiment. FIG. 13 shows the measurement results of optical density (OD) on the display surface side at each pulse voltage when the surface electrode 16 is grounded (0 V) and a pulse voltage is applied to the back electrode 22. The optical density is measured by a reflection densitometer (X-Rite 404) made by X-Rite while gradually changing the pulse voltage in an incremental manner (the applied voltage is increased or reduced).

In the present exemplary embodiment, the charging amounts and the particle diameters (volume average particle diameters) of the respective colored particles 32 are made different, so that the adhering force between the respective colored particles 32 and the surface layer 17 of the display substrate 18 is made different from the adhering force between the respective colored particles 32, and the moving start voltages of the first and second colored particles 32A and 32B are made different from each other. In addition, the display density characteristics of the respective colored particles 32 may be controlled by the difference in the adhering force described above and may be controlled by the difference in the mobility of the respective colored particles 32 in a separate manner.

In the present exemplary embodiment, when a voltage of $|V1|$ or higher is applied, the first colored particles 32A start moving between the substrates. When a voltage of $|V2|$ ($V1<V2$) or higher is applied, the second colored particles 323 start moving between the substrates. That is, the applied voltages are set to be within a different voltage range so that the ranges of voltages necessary of moving the respective colored particles 32 do not overlap, and the respective colored particles 32 have different charging characteristics.

Therefore, in an image display device in which the number of colored particles 32 is different, similarly to the first exemplary embodiment, by applying a voltage every predetermined refresh setting period after writing images such that the colored particles 32 adhered to the substrate are not separated and moved from the substrate and such that force is applied to a substrate to which at least one group of colored particles 32 (colored particles having the lowest threshold voltage necessary for moving in accordance with an electric field among the plural groups of colored particles 32) are adhered, the memory performance of images is improved similarly to the first exemplary embodiment.

Specifically, in the second exemplary embodiment, when the first colored particles 32A are present on both the display substrate 18 and the back substrate 28 when an image is written, by applying a positive or negative pulse voltage lower than a voltage for moving the first colored particles 32A similarly to the above exemplary embodiment or alternately applying positive and negative pulse voltages lower than the voltage for moving the first colored particles 32A, the adhering force toward the substrate, of the first colored particles 32A is augmented, and the memory performance is improved.

Moreover, when all (or a majority part) of the first colored particles 32A are present on one of the substrate sides, by applying a pulse voltage having such a polarity that the first colored particles 32A are moved toward the substrate where the particles are present and higher than the voltage for moving the first colored particles 32A and lower than the voltage for moving the second colored particles 32B, the adhering force toward the substrate, of the first colored particles 32A is augmented, and the memory performance is improved.

Therefore, in the present exemplary embodiment, the controller 42 determines a pulse voltage and the polarity thereof, having such a magnitude that the colored particles 32 are not separated and moved from the substrate based on the last image information used for writing images after controlling the imaging writing operation and controls the voltage applying unit 40 so as to apply the determined pulse voltage every predetermined refresh period between the substrates, the memory performance of the image display device is improved.

In addition, the control of the voltage applying unit by the controller in the respective exemplary embodiments may be executed by hardware and may be performed by executing a software program. The program may be distributed by being stored in various storage media.

Moreover, in the respective exemplary embodiments, although the particle adhering field is applied every predetermined refresh setting period, the present invention is not limited to this. The refresh (application of the particle adhering field) may be performed in response to a user operation as a trigger, and the refresh may be performed based on a fixing state of particles determined on the control side of the image display medium.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image display medium driver comprising:

a voltage applying unit that applies a writing pulse as a voltage between a pair of substrates of an image display medium that displays an image based on image information, the image display medium including a plurality of groups of colored particles colored in a color which is different for every group, enclosed between the pair of substrates, at least one of the substrates having transparent properties, each group of colored particles being moved when an absolute value of the voltage is equal to or higher than a threshold voltage, the threshold voltage being different for each group of the colored particles; and a controller that determines which of the substrates the colored particles are present on for each group of the colored particles based on a last image information used for displaying an image, and when the colored particles are present on both of the substrates, controls the voltage applying unit so as to apply a voltage having a smaller absolute value than any threshold voltage of the colored particles present on one of the substrates, and the voltage having a smaller absolute value is applied in a plurality of voltage pulses to create a particle adhering field extending in a direction from one of the substrates toward an other one of the substrates, and the voltage having a smaller absolute value is applied as the plurality of voltage pulses after the writing pulse and before a new writing pulse is applied, wherein the controller controls the voltage applying unit so as to apply a voltage having a smaller absolute value than any threshold voltage of the colored particles present on one of the substrates to create a particle adhering field extending in a direction from the one of the substrates toward the other one of the substrates and a voltage having a smaller absolute value than any threshold voltage of the colored particles present on the other one of the substrates to create a particle adhering field extending in a direction from the other one of the substrates toward the one of the substrates.

2. The image display medium driver according to claim 1, wherein when the colored particles are present on only one of the substrates, the controller controls the voltage applying unit so as to apply a voltage to create the particle adhering field extending in a direction from the other one of the substrates toward the one of the substrates.

3. An image display device comprising:

an image display medium including a plurality of groups of colored particles colored in different colors, enclosed between a pair of substrates, having different threshold voltages necessary for moving in accordance with an electric field, at least one of the substrates having transparent properties; and the image display medium driver according to claim 1.

4. An image display medium driving method comprising:

applying a writing pulse as a voltage between a pair of substrates of an image display medium that displays an image based on image information, the image display medium including a plurality of groups of colored particles colored in a color which is different for every group, enclosed between the pair of substrates, at least one of the substrates having transparent properties, each group of the colored particles being moved when an absolute value of the voltage is equal to or higher than a threshold voltage, is the threshold voltage being different for each group of the colored particles;

determining a substrate on which the colored particles are present for each group of the colored particles based on a last image information used for displaying an image, and when the colored particles are present on both of the substrates; and controlling application of the voltage so as to apply a voltage having a smaller absolute value than any threshold voltage of the colored particles present on one of the substrates, and the voltage having a smaller absolute value is applied in a plurality of voltage pulses to create a particle adhering field extending in a direction from one of the substrates toward the other one of the substrates, and the voltage having a smaller absolute value is applied as the plurality of voltage pulses after the writing pulse and before a new writing pulse is applied, wherein controlling the voltage applying unit so as to apply a voltage having a smaller absolute value than any threshold voltage of the colored particles present on one of the substrates is to create a particle adhering field extending in a direction from the one of the substrates toward the other one of the substrates and a voltage having a smaller absolute value than any threshold voltage of the colored particles present on the other one of the substrates is to create a particle adhering field extending in a direction from the other one of the substrates toward the one of the substrates.

* * * * *